US005687544A

United States Patent [19]

Watabe et al.

[11] Patent Number: 5,687,544

[45] Date of Patent: Nov. 18, 1997

[54] PACKAGING AND SEALING APPARATUS

[75] Inventors: Nobuyuki Watabe; Taijiro Fujita; Kazuo Okutsu; Makoto Ikeda; Yoshiyuki Ishii, all of Minamiashigara, Japan

[73] Assignee: Fuji Photo Film Co., Ltd., Kanagawa, Japan

[21] Appl. No.: 647,733

[22] Filed: May 15, 1996

[30] Foreign Application Priority Data

| | | | |
|---|---|---|---|
| May 16, 1995 | [JP] | Japan | 7-117333 |
| May 16, 1995 | [JP] | Japan | 7-117441 |
| Aug. 3, 1995 | [JP] | Japan | 7-198618 |

[51] Int. Cl.[6] ..... B65B 7/10; B65B 43/34; B65B 43/52; B65B 51/06

[52] U.S. Cl. ..... 53/136.5; 53/284.7; 53/372.7; 53/386.1; 53/570

[58] Field of Search ..... 53/570, 284.7, 53/372.7, 372.8, 386.1, 136.5

[56] References Cited

U.S. PATENT DOCUMENTS

| | | | |
|---|---|---|---|
| 3,855,907 | 12/1974 | Johnson et al. | 53/570 X |
| 4,393,640 | 7/1983 | Cole et al. | 53/386.1 X |
| 4,430,844 | 2/1984 | James | 53/550 X |
| 5,152,124 | 10/1992 | Ishii et al. | 53/570 |

FOREIGN PATENT DOCUMENTS

| | | | |
|---|---|---|---|
| 61-273461 | 12/1986 | Japan | B65H 35/07 |
| 4-87910 | 3/1992 | Japan | B65B 5/00 |

*Primary Examiner*—Horace M. Culver

*Attorney, Agent, or Firm*—Sughrue,Mion,Zinn,Macpeak & Seas, PLLC

[57] ABSTRACT

A packaging and sealing apparatus has an opening mechanism for forming the package forcibly to an open configuration, an inserting mechanism for inserting the product into the package which has been formed by the opening mechanism, an open end forming mechanism for forming flatwise an open end of the package with the product inserted therein, a folding mechanism for folding the flatwise formed open end into a folded end, and a sealing mechanism for fixing the folded end. The opening mechanism, the inserting mechanism, the open end forming mechanism, the folding mechanism, and the sealing mechanism are successively arranged along a direction in which the package is conveyed by a conveyor.

48 Claims, 38 Drawing Sheets

PACKAGING AND SEALING APPARATUS

BACKGROUND OF THE INVENTION

1. Field of the Invention

The present invention relates to an apparatus for opening an end of a package, inserting a product into the package, and folding back and sealing the open end of the package.

2. Description of the Related Art

There have been proposed various packaging and sealing apparatus for automatically inserting a roll of photographic photosensitive material into a gusseted package and thereafter folding back and sealing the open end of the gusseted package along a production line.

As disclosed in Japanese laid-open patent publication No. 4-87910, one known packaging and sealing apparatus has a conveyor means for conveying gusseted packages with open ends thereof directed perpendicularly to the direction in which it is conveyed, a product inserting station to which the packages are successively conveyed by the conveyor means, an open end processing station, and a plurality of open end folding stations.

In the product inserting station, the open end of each of the packages is vertically opened under suction by a pair of upper and lower suction cups, and a product, i.e., a roll of photographic photosensitive material, is inserted into the package through the open end. In the open end processing station, the open end of each of the packages is collapsed into a substantially flat form by six fingers that move horizontally and forming plates that vertically sandwich the open end. In the open end folding stations, the open end of each of the packages which has been collapsed substantially flatwise is folded in a plurality of steps.

In the product inserting station, the open end of each of the packages is drawn open by the suction cups, and a product is inserted into the package through the open end. Therefore, only the open end of the package is opened whereas the bottom end thereof remains substantially flat. Therefore, when the product is inserted into the package through the open end, the inserted product forcibly spreads the package, which tends to be unduly wrinkled.

If the package is wrinkled when the product is inserted therein, then the package is deformed out of shape, causing the open end to be wrinkled or more wrinkled when the open end is closed and folded back. Therefore, when the open end is folded back, the wrinkles make it difficult for the folded end to be gripped, and the folded end is liable to unfold, resulting in a folding failure.

Since the package is spread by the inserted product, the package and the product slidingly contact each other, and the product is likely to be damaged and finished in a faulty condition.

The above conventional apparatus is also disadvantageous in that packages may be positionally displaced while being conveyed and the open ends thereof may not be opened into a rectangular shape, so that products cannot be inserted into the packages.

Generally, products such as rolls of photographic photosensitive material to be packaged have various different sizes. Therefore, there are available different sizes of packages dedicated to those products of different sizes. To handle products and packages of different sizes, each of the product inserting station, the open end processing station, and the open end folding stations is required to make various adjustments depending on the dimensions of the products and packages to be used.

However, the adjustment process required when dimensions of the products and packages to be used are changed is tedious and time-consuming because the adjustments have to be made in each of the product inserting station, the open end processing station, and the open end folding stations. If an increased number of open end folding stations are needed to fold the open ends of packages in an increased number of folding steps, then the adjustment process which is carried out in each of the open end folding stations is considerably tedious and time-consuming.

SUMMARY OF THE INVENTION

It is a general object of the present invention to provide a packaging and sealing apparatus which is capable of packaging products highly efficiently and accurately by reliably forming the open ends of packages into a desired shape before the products are inserted into the packages thereby to prevent the packages from being wrinkled when the products are inserted into the packages.

A major object of the present invention is to provide a packaging and sealing apparatus which is capable of quickly and easily changing dimensions of products to be packaged and packages for thereby efficiently packaging products of various different sizes or dimensions.

Another object of the present invention is to provide a packaging and sealing apparatus which is of a simple structure for easily and automatically fixing the open ends of packages in which products of complex shape have been inserted.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
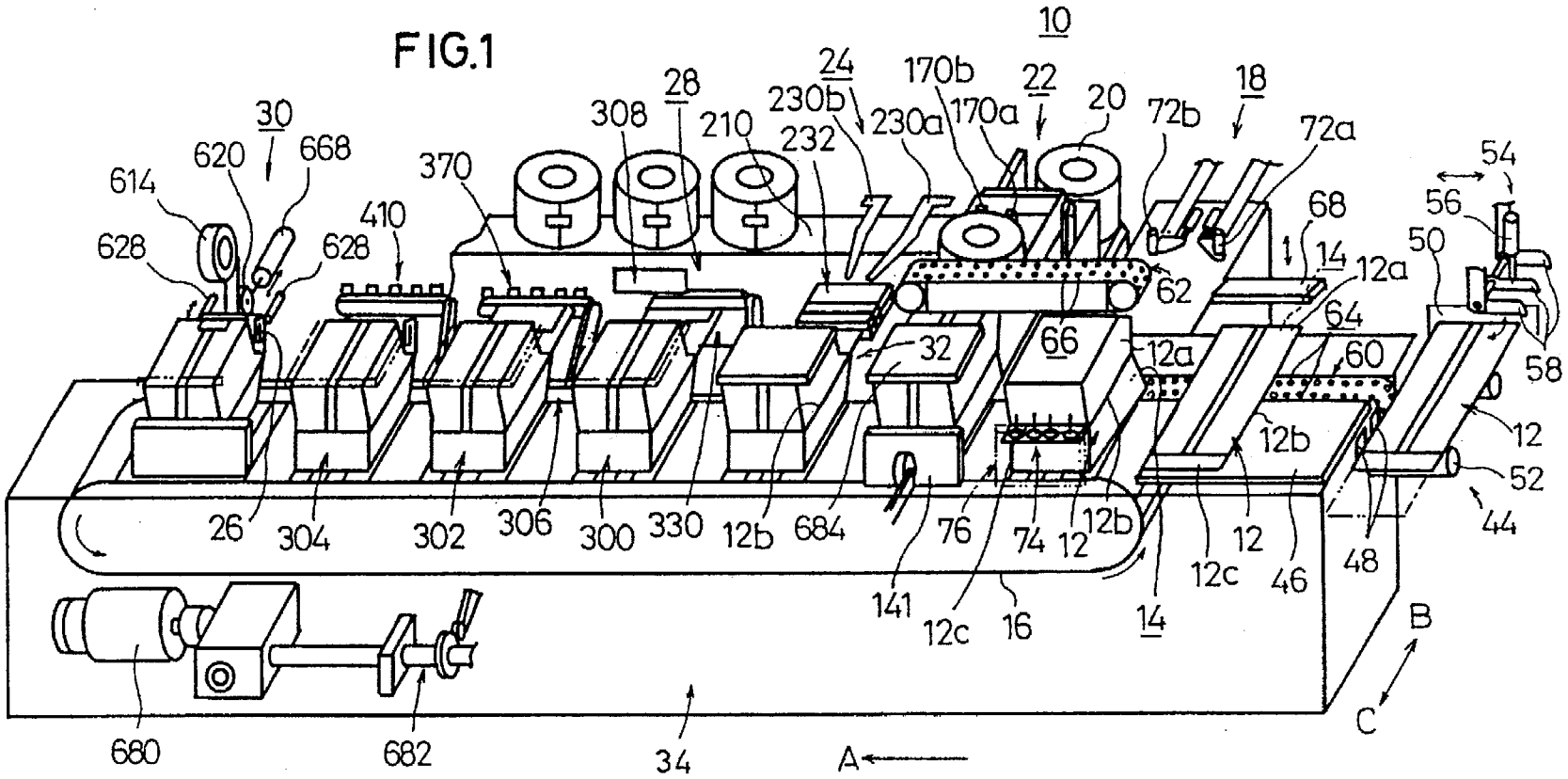
FIG. 1 is a schematic perspective view of a packaging and sealing apparatus according to the present invention.

As shown in FIG. 1, a packaging and sealing apparatus 10 according to the present invention generally comprises a conveyor 16 for conveying a gusseted package 12 which includes an open end 12*a* having an opening 14 directed in the direction indicated by he arrow B perpendicular to the direction indicated by the arrow A in which the package 12 is conveyed, an opening mechanism 18 for forcibly opening the open end 12*a* of the gusseted package 12 into a predetermined shape, an inserting mechanism 22 for inserting a product 20 in the form of a roll into the opened gusseted package 12, an open end forming mechanism 24 for flattening the open end 12*a* of the gusseted package 12 with the product 20 inserted therein, a folding mechanism 28 for folding back the flattened open end 12*a* three times into a folded end 26, a sealing mechanism 30 for taping the folded end 26, and a movable block 32 for vertically moving the open end forming mechanism 24 and the folding mechanism 28 in unison with each other with respect to the conveyor 16.

Figure 2:
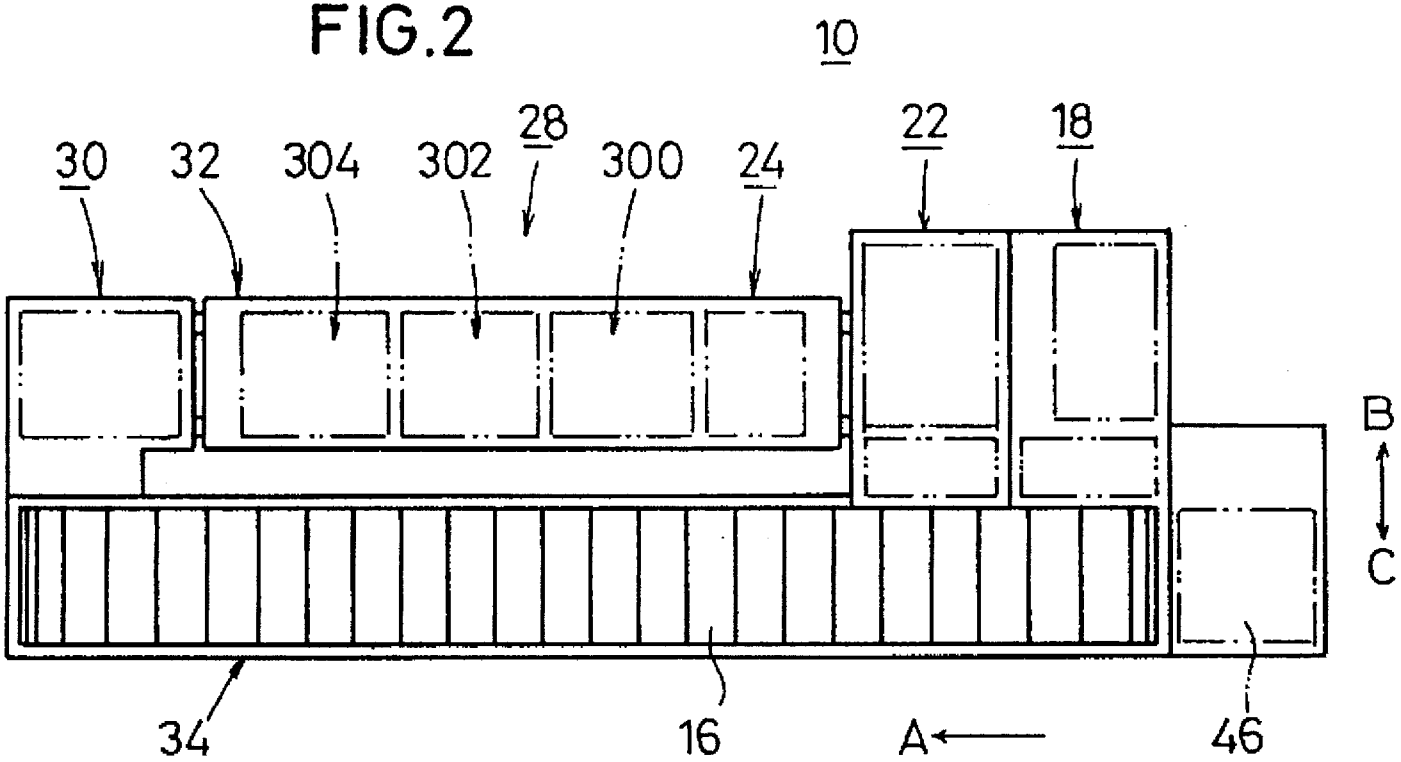
FIG. 2 is a plan view of a movable block and a fixed block of the packaging and sealing apparatus.

As shown in FIG. 2, the conveyor 16, the opening mechanism 18, the inserting mechanism 22, and the sealing mechanism 30 are mounted on a fixed block 34, and the open end forming mechanism 24 and the folding mechanism 28 are mounted on the movable block 32 which is vertically movable with respect to the fixed block 34. The opening mechanism 18, the inserting mechanism 22, open end forming mechanism 24, the folding mechanism 28, and the sealing mechanism 30 are arrayed in the order named in the direction indicated by the arrow A.

Figure 3:
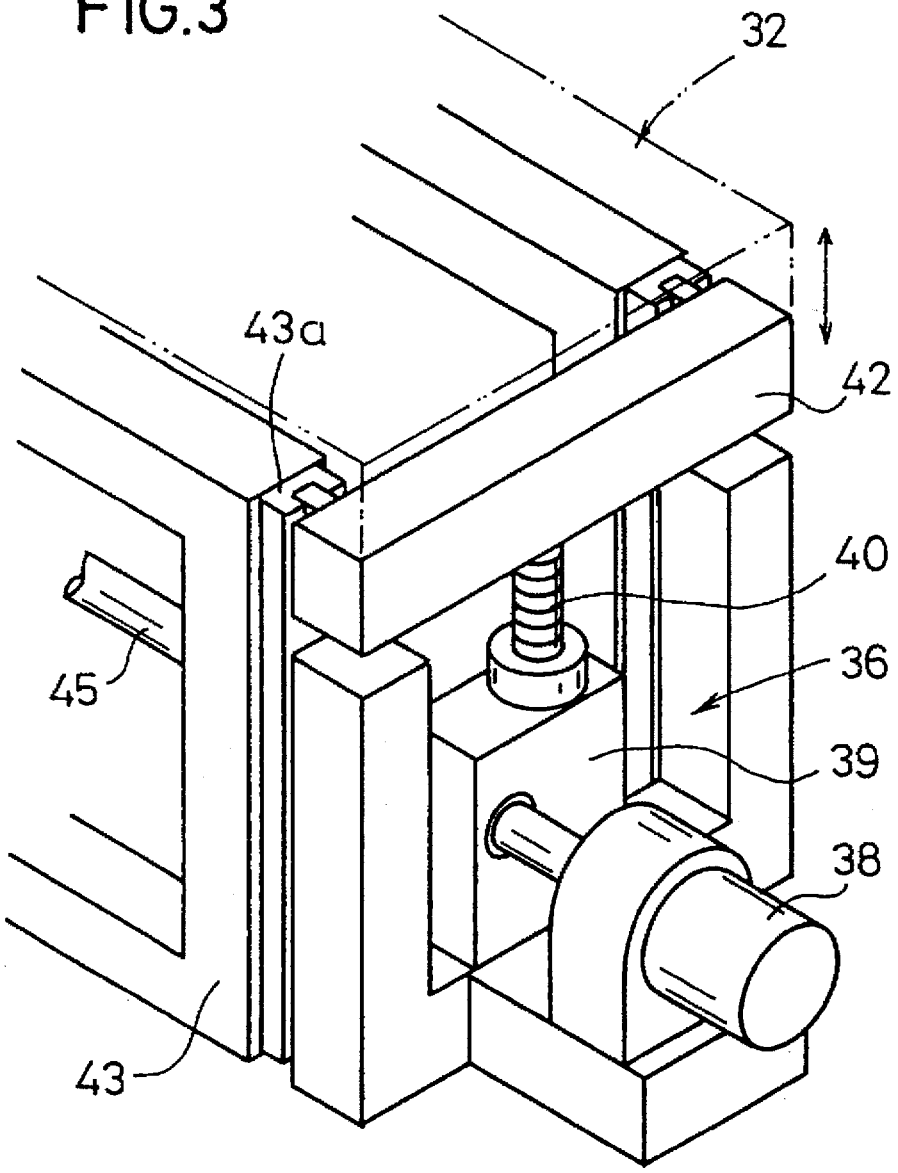
FIG. 3 is a perspective view of a lifting and lowering mechanism for vertically moving the movable block.

As shown in FIG. 3, the movable block 32 is vertically movable with respect to the fixed block 34 by a lifting and lowering mechanism 36. The lifting and lowering mechanism 36 has a speed reducer 39 coupled to a motor 38 and a ball screw 40 rotatable by the speed reducer 39 and connected to the movable block 32 through a horizontal bar 42. The movable block 32 is supported on the horizontal bar 42. The horizontal bar 42 engages vertical guide rails 43*a* which are secured to a fixed base 43. A joint rod 45 extends horizontally from the speed reducer 39, and is operatively coupled to another ball screw connected to another horizontal bar (not shown) which also supports the movable block 32. The lifting and lowering mechanism 36 may alternatively comprise another actuating mechanism such as a cylinder mechanism, a rack and pinion mechanism, or the like.

As shown in FIG. 1, the fixed block 34 supports thereon a transfer device 46 positioned at an end of the conveyor 16 for transferring a gusseted package 12 positioned and delivered from a package loader 44 onto the conveyor 16.

The package loader 44 comprises vertically movable positioning fingers 48 for engaging a leading edge of a gusseted package 12, a plurality of rollers 52 for feeding the gusseted package 12 which has engaged the positioning fingers 48 in the direction indicated by the arrow B until the open end 12*a* thereof abuts against a positioning plate 50, and a feeder 54 for feeding the gusseted package 12 which has been positioned by the positioning plate 50 toward the conveyor 16. The feeder 54 has a plurality of swing fingers 58 which are movable in the direction indicated by the arrow A and swingable about ends thereof by a cylinder 56.

A lower suction belt 60 extends from the transfer device 46 to a position corresponding to the inserting mechanism 22, for attracting under suction a lower surface of the open end 12*a* of a gusseted package 12. An upper suction belt 62 extends from the opening mechanism 18 to the position corresponding to the inserting mechanism 22, for attracting under suction an upper lower surface of the open end 12*a* of the gusseted package 12. The lower and upper suction belts 60, 62 comprise respective endless belts and have a plurality of suction holes 64, 66 respectively, arranged in transverse arrays. The transfer device 46 includes a vertically movable presser plate 68 for pressing the lower surface of the open end 12*a* of the gusseted package 12 against the lower suction belt 60 for enabling the lower suction belt 60 to attract the lower surface of the open end 12*a* reliably.

Figure 4:
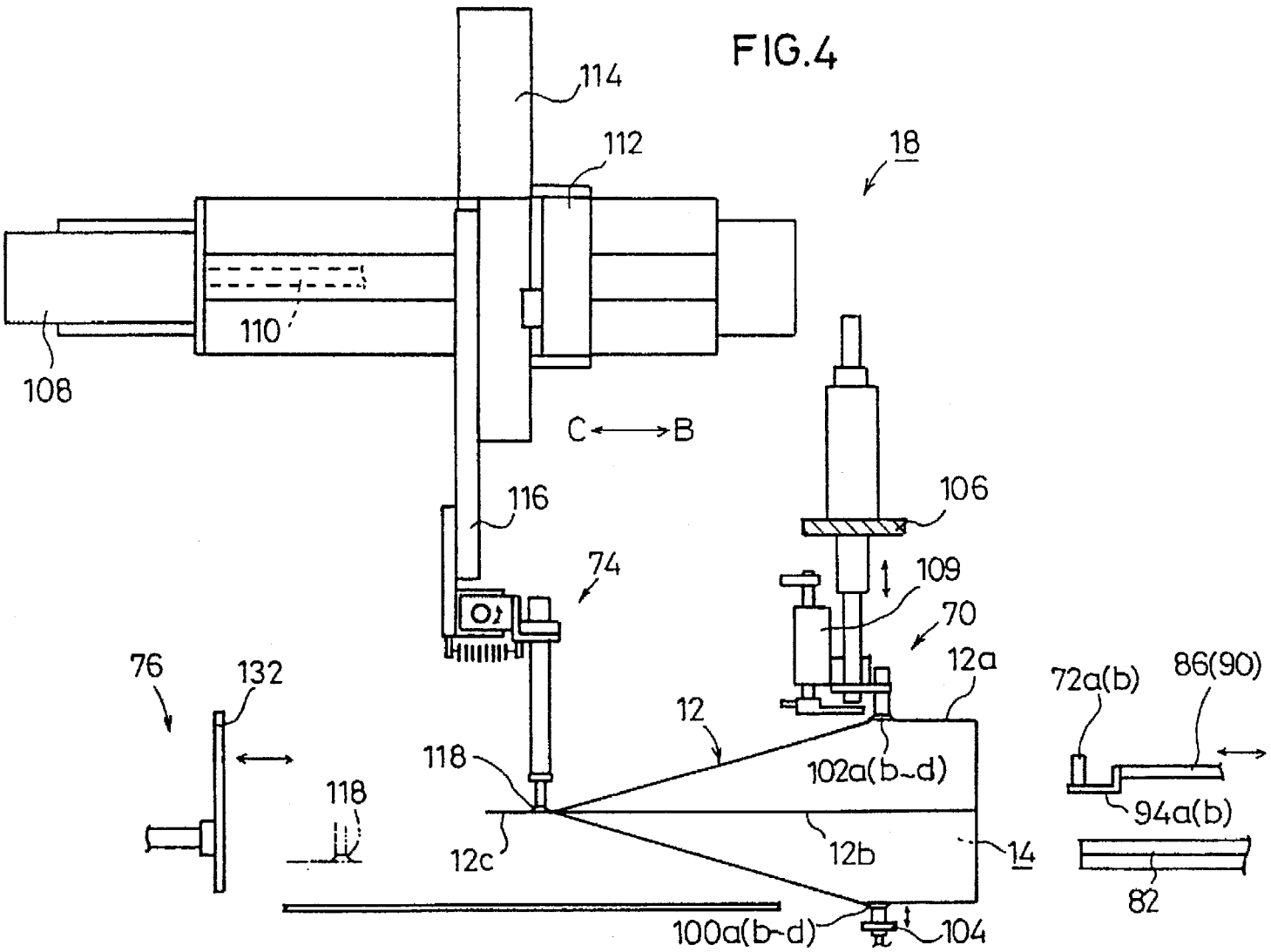
FIG. 4 is a side elevational view of an opening mechanism of the packaging and sealing apparatus.
Figure 5:
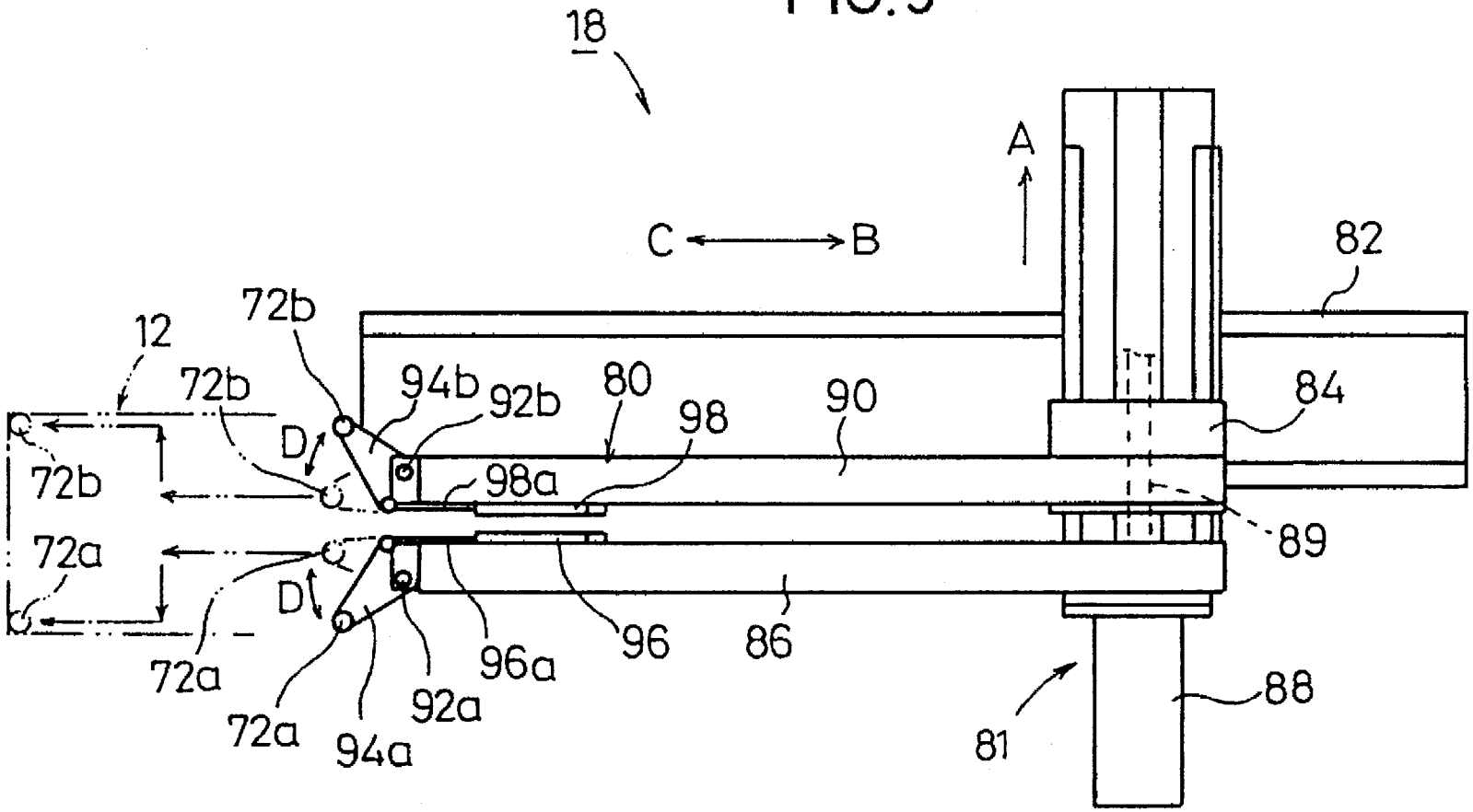
FIG. 5 is a plan view of a system for actuating a pair of gusset rollers of the opening mechanism.

As shown in FIGS. 4 and 5, the opening mechanism 18 comprises a suction device 70 for attracting under suction upper and lower layers of a gusseted package 12 to open the gusseted package 12, a pair of gusset rollers 72*a*, 72*b* movable into the gusseted package 12 to spread apart gussets 12*b* on both sides of the gusseted package 12, a bottom suction device 74 for attracting under suction a bottom 12*c* of the gusseted package 12 to hold the bottom 12*c* in a substantially vertically intermediate position across the height of the gusseted package 12 as it is opened, a bottom forming device 76 for pressing the bottom 12*c*, an opening and closing device 80 for angularly displacing the gusset rollers 72*a*, 72*b* in the directions indicated by the arrows D within the gusseted package 12 in its transverse directions, and a distance adjusting device 81 for adjusting the distance between the gusset rollers 72*a*, 72*b* to match the width of the gusseted package 12.

The distance adjusting device 81 has a movable body 84 movable back and forth along a guide rail 82 extending in the directions indicated by the arrows B, C. The distance adjusting device 81 also has a first support bar 86 which is elongate in the direction indicated by the arrow C and fixedly mounted on the movable body 84. A motor 88 having its axis extending in the direction indicated by the arrow A is fixedly mounted on the movable body 84. The distance adjusting device 81 also has a second support bar 90 which is elongate in the direction indicated by the arrow C and spaced transversely from the first support bar 86. The second support bar 90 is threadedly mounted on a ball screw 89 coupled to the rotatable output shaft of the motor 88, so that the second support bar 90 can move back and forth in the directions indicated by the arrow A in response to rotation of the ball screw 89.

Swing arms 94*a*, 94*b* are swingably supported on respective distal ends of the first and second support bars 86, 90 by respective shafts 92*a*, 92*b*. The gusset rollers 72*a*, 72*b* are rotatably mounted on the respective swing arms 94*a*, 94*b* for rotation about respective vertical axes. The opening and closing device 80 has a pair of cylinders 96, 98 fixedly mounted on respective edges of the distal ends of the first and second support bars 86, 90. The cylinders 96, 98 have respective rods 96*a*, 98*a* engaging respective ends of the swing arms 94*a*, 94*b* (see FIGS. 5 and 6).

Figure 7:
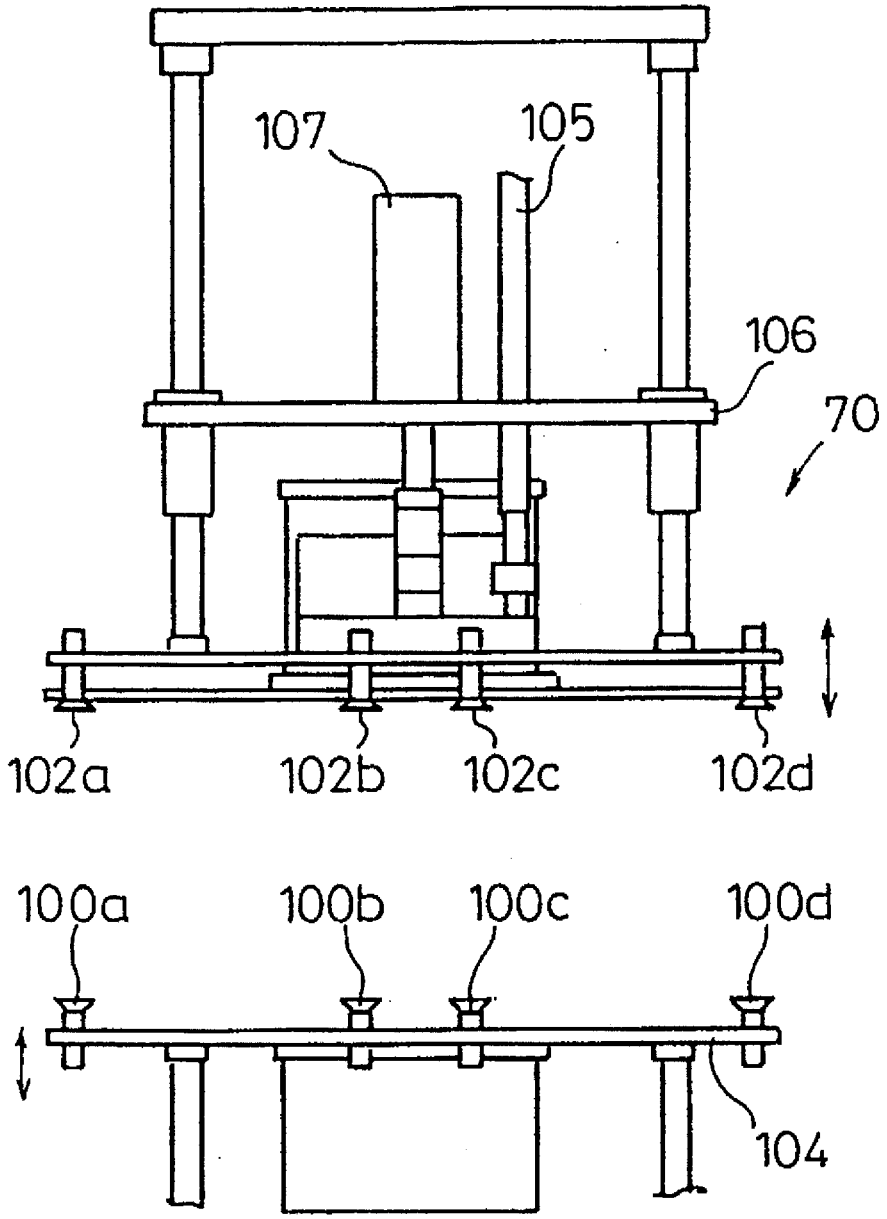
FIG. 7 is a front elevational view of a suction device of the opening mechanism.

As shown in FIGS. 4 and 7, the suction device 70 comprises a plurality of lower suction cups 100*a*~100*d* for attracting under suction the lower surface of the open end 12*a* of a gusseted package 12, and a plurality of upper suction cups 102*a*~102*d* for attracting under suction the upper surface of the open end 12*a* of the gusseted package 2. The lower suction cups 100*a*~100*d* and the upper suction cups 102*a*~102*d* are vertically aligned with each other in a symmetrical configuration, and selectively actuatable to effect a suction operation depending on the size of the gusseted package 12. The lower suction cups 100*a*~100*d* and the upper suction cups 102*a*~102*d* are supported respectively on vertically movable frames 104, 106.

As shown in FIG. 7, the upper suction cups 102*a*~102*d* are vertically movable by a cam rod 105 which is vertically movable by a cam mechanism (described later on), and are also vertically movable a given distance by a cylinder 107. A curl correcting cylinder 109 (see FIG. 4) for correcting the gusseted package 12 out of a curled condition is positioned in the vicinity of the upper suction cups 102*a*~102*d*.

As shown in FIG. 4, the bottom suction device 74 has a slide base 112 movable horizontally in the directions indicated by the arrows B, C by a ball screw 110 coupled to a size changer motor 108, and a vertically movable arm 116 coupled through a ball screw (not shown) to a motor 114 mounted on an upper surface of the slide base 112. A plurality of suction cups 118 arrayed in the direction indicated by the arrow A are swingably supported on a lower end of the vertically movable arm 116.

Figure 8:
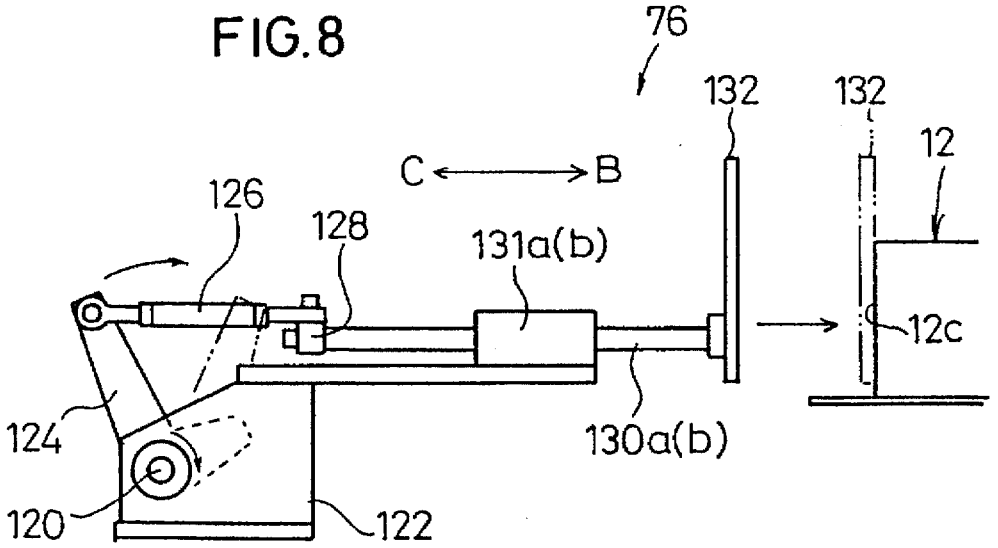
FIG. 8 is a side elevational view of a bottom forming device of the opening mechanism.

As shown in FIG. 8, the bottom forming device 76 has a horizontal pivot shaft 120 which is angularly movable about its own axis through a predetermined angular range. The pivot shaft 120 is angularly movably supported by a base 122. The bottom forming device 76 also has an arm 124 projecting upwardly from an horizontally intermediate portion of the pivot shaft 120. The arm 124 has a distal end connected through a connecting rod 126 to a rectangular body 128 to which ends of a pair of rods 130*a*, 130*b* are connected. The rods 130*a*, 130*b* are slidably supported by respective guide members 131*a*, 131*b* mounted on the base 122 for horizontal sliding movement. A vertical forming plate 132 is securely fixed to the other ends of the rods 130*a*, 130*b*.

Figure 9:
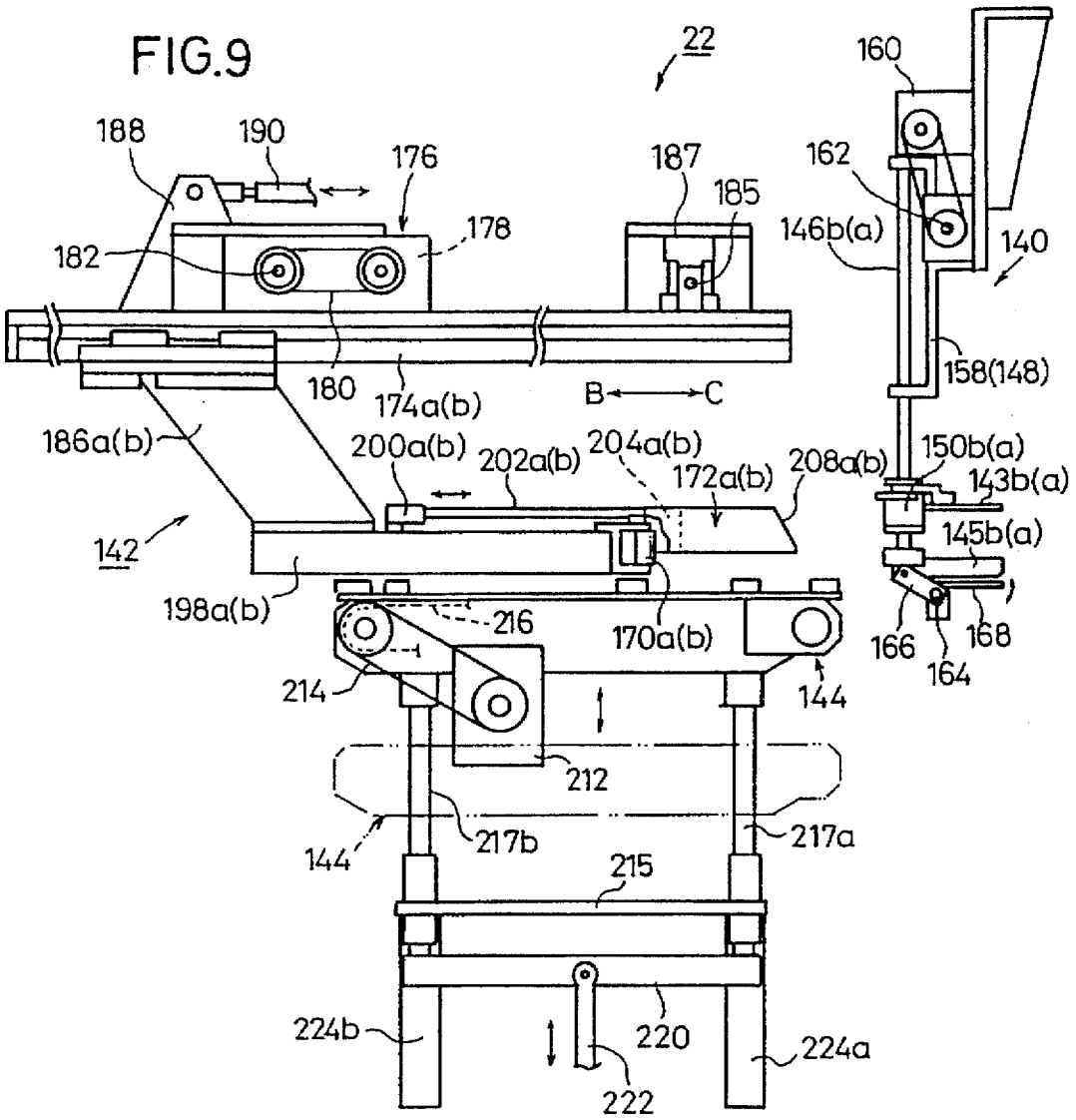
FIG. 9 is a side elevational view of an inserting mechanism of the packaging and sealing apparatus.
Figure 10:
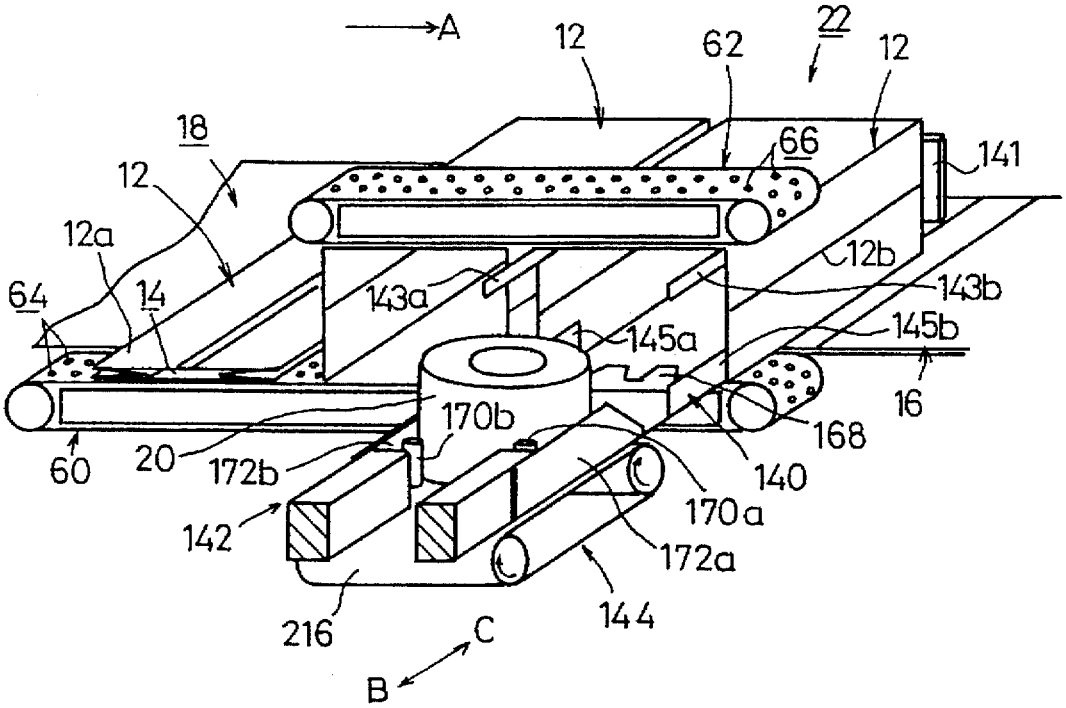
FIG. 10 is a fragmentary perspective view of the inserting mechanism.

As shown in FIGS. 9 and 10, the inserting mechanism 22 comprises a corner guide device 140 for being inserted into an open gusseted package 12 to keep the gusseted package 12 open, a pushing device 142 for inserting a product 20 into the gusseted package 12 which is held by the corner guide device 140, an insertion conveyor 144 which is vertically movable while the product 20 is being placed thereon, and a product bearing plate 141 for pressing the bottom 12*c* of the gusseted package 12.

Figure 11:
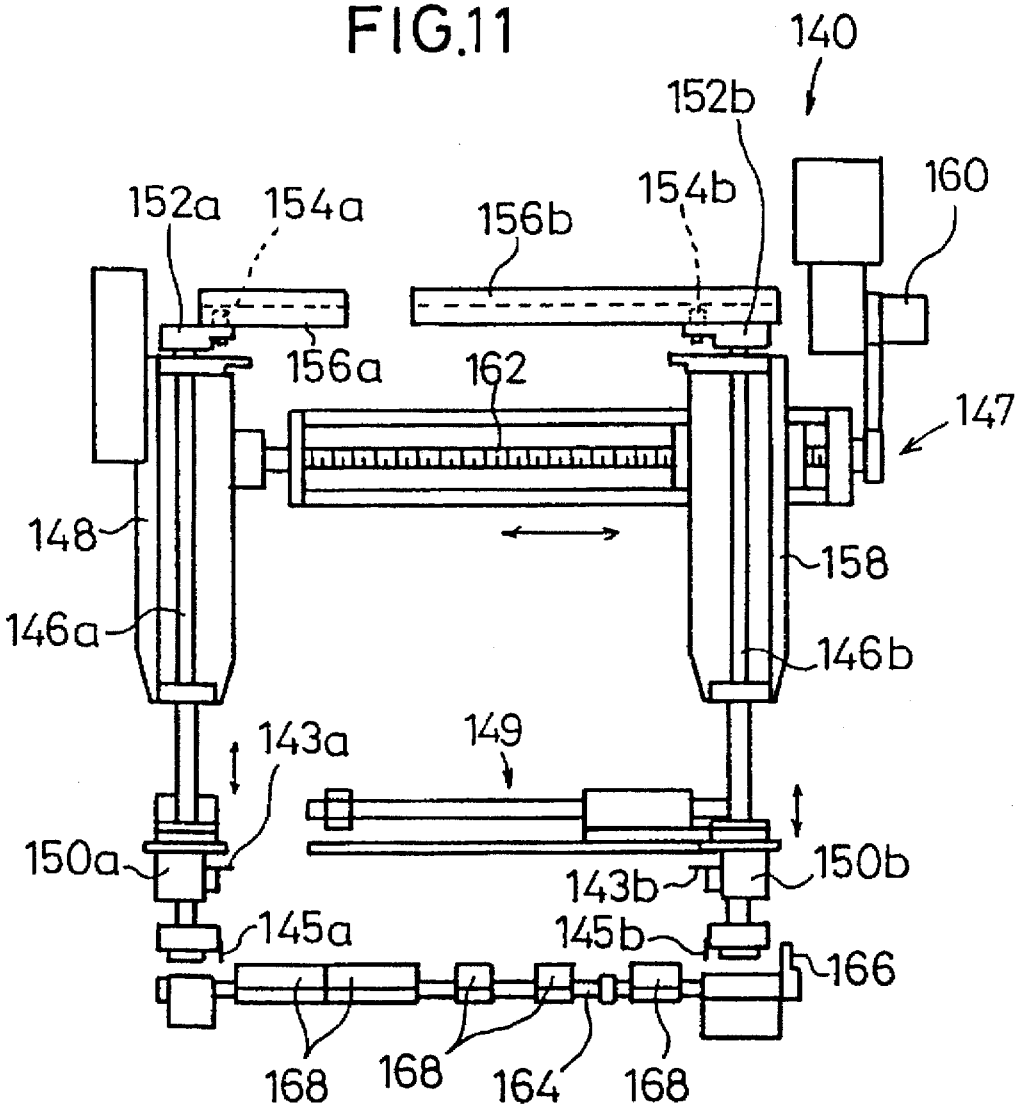
FIG. 11 is a front elevational view of a corner guide device of the inserting mechanism.

As shown in FIGS. 9 and 11, the corner guide device 140 comprises a pair of upper guide members 143*a*, 143*b* and a pair of lower guide members 145*a*, 145*b* for engaging upper and lower portions, respectively, of the opposite sides of a gusseted package 12, a pair of vertical pivot shafts 146*a*, 146*b* for angularly moving the upper guide members 143*a*, 143*b* and the lower guide members 145*a*, 145*b*, respectively, horizontally, a horizontal moving device 147 for horizontally moving the pivot shaft 146*b* toward and away from the pivot shaft 146*a* depending on the width of the gusseted package 12, and a vertical moving device 149 for vertically moving the upper guide members 143*a*, 143*b* toward and away from the lower guide members 145*a*, 145*b*.

As shown in FIG. 11, the pivot shaft 146*a* is vertically supported by a frame 148 for rotation about its own axis. The lower guide member 145*a* is fixed to a lower end of the pivot shaft 146*a*, and the upper guide member 143*a* is vertically adjustably supported on a lower portion of the pivot shaft 146*a* above the lower guide member 145*a* through a slider 150*a* of the vertical moving device 149. A rotatable member 152*a* is fixed to an upper end of the pivot shaft 146*a*, and has a pin 154*a* fixed thereto which is held in engagement with a horizontally movable cam 156*a*.

The pivot shaft 146*b* is vertically supported by a movable frame 158 for rotation about its own axis. The movable frame 158 threadedly engages a horizontal ball screw 162 which is coupled to a motor 160 of the horizontal moving device 147. The lower guide member 145*b* is fixed to a lower end of the pivot shaft 146*b*, and the upper guide member 143*b* is vertically adjustably supported on a lower portion of the pivot shaft 146*b* above the lower guide member 145b through a slider 150b of the vertical moving device 149. A rotatable member 152b is fixed to an upper end of the pivot shaft 146b, and has a pin 154b fixed thereto which is held in engagement with a horizontally movable cam 156b.

A horizontal turn shaft 146 is positioned below the pivot shafts 146a, 146b, and a swing cam 166 is fixed to an end of the turn shaft 146 (see FIGS. 9 and 11). A plurality of package presser plates 168 of respective shapes are fixedly mounted on a turn shaft 164 at given spaced intervals.

Figure 12:
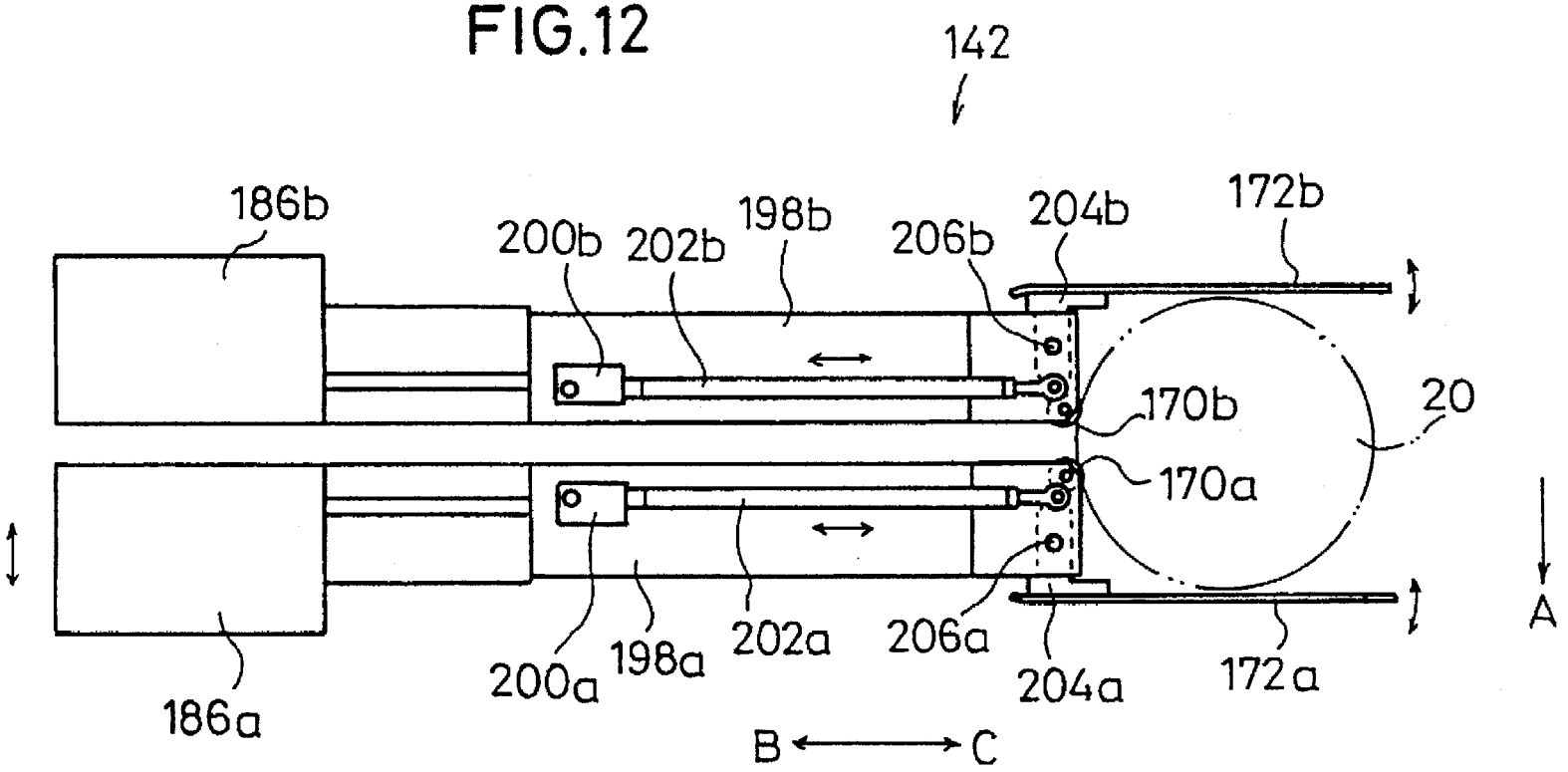
FIG. 12 is a front elevational view of a pushing device of the inserting mechanism.

As shown in FIGS. 9, 10, and 12, the pushing device 142 comprises a pair of rollers 170a, 170b for pressing a product 20 while centering the same, a pair of side guide plates 172a, 172b positioned one on each side of the product 20 for preventing the product 20 from contacting the gusseted package 12, and a distance adjusting device 176 for adjusting the distance between the rollers 170a, 170b and the distance between the side guide plates 172a, 172b depending on the size of the product 20.

Figure 13:
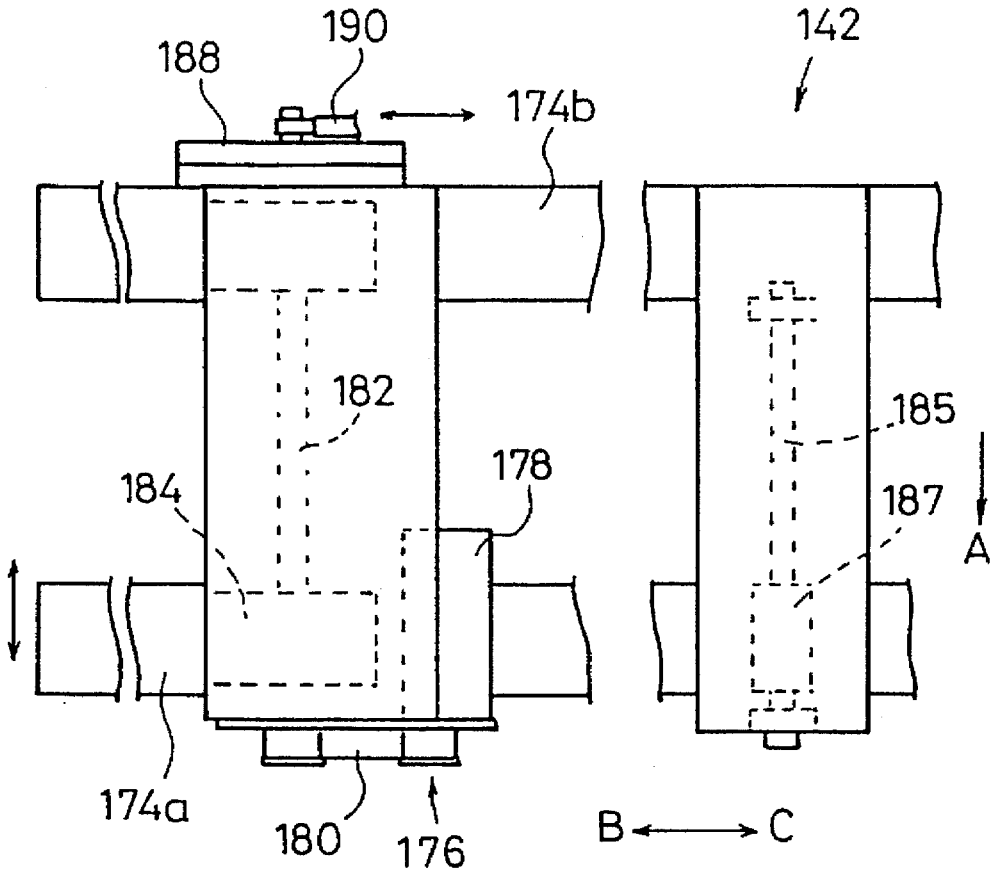
FIG. 13 is a plan view of a distance adjusting device of the pushing device.
Figure 14:
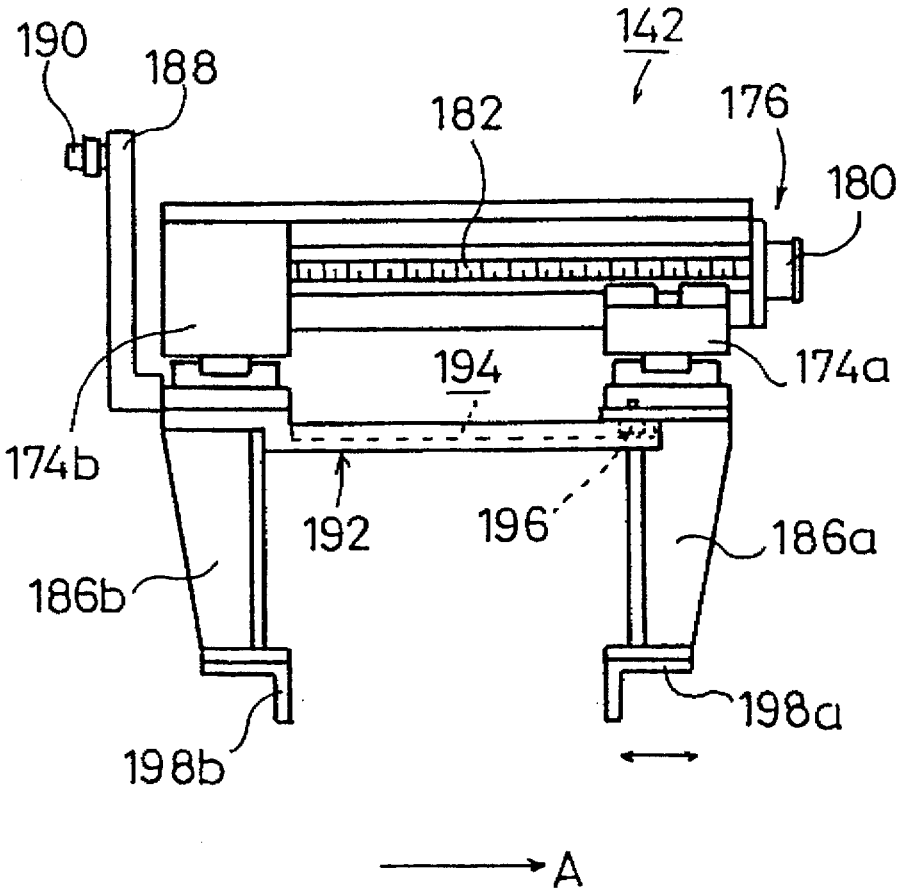
FIG. 14 is a rear elevational view of the pushing device.

As shown in FIGS. 9, 13, and 14, the pushing device 142 comprises a movable guide member 174a and a fixed guide member 174b which extend parallel to each other in the directions indicated by the arrows B, C, the movable guide member 174a being movable toward and away from the fixed guide member 174b in the directions indicated by the arrow A. The distance adjusting device 176 is mounted on the movable guide member 174a and the fixed guide member 174b.

The distance adjusting device 176 comprises a motor 178 having a rotatable output shaft which is operatively coupled to a ball screw 182 by a belt and pulley mechanism 180. The ball screw 182 extends in the direction indicated by the arrow A, and is rotatably supported by the fixed guide member 174b and threadedly fits over a nut 184 mounted on the movable guide member 174a. On distal end portions of the movable guide member 174a and the fixed guide member 174b, there are mounted a guide rod 185 having an end fixed to the fixed guide member 174b and a guide member 187 disposed on the movable guide member 174a and receiving an opposite end of the guide rod 185.

Slide bases 186a, 186b are supported respectively on lower surfaces of the movable and fixed guide members 174a, 174b. A cam rod 190 is operatively connected through a plate 188 to the slide base 186b.

As shown in FIG. 14, a joint arm 192 is horizontally fixed to the slide base 186b and extends toward the slide base 186a. The joint arm 192 has an elongate groove 194 defined therein which receives a guide pin 196 fixed to the slide base 186a. The joint arm 192 serves to transmit drive forces applied to the cam rod 190 to the slide base 186a. Therefore, even when the slide base 186a is moving in the direction indicated by the arrow A, the drive forces applied to the cam rod 190 are transmitted to the slide base 186a through the elongate groove 194 and the guide pin 196.

As shown in FIGS. 9 and 12, attachment plates 198a, 198b which are elongate in the direction indicated by the arrow C are fixed to lower ends of the slide bases 186a, 186b, respectively, and the rollers 170a, 170b are rotatably supported on respective distal ends of the attachment plates 198a, 198b for rotation about their respective vertical axes. The attachment plates 198a, 198b support thereon respective cylinders 200a, 200b having respective elongate rods 202a, 202b. Swing bars 204a, 204b are swingably supported on the respective distal ends of the attachment plates 198a, 198b by respective support shafts 206a, 206b, and are operatively coupled to respective distal ends of the elongate rods 202a, 202b. The side guide plates 172a, 172b have ends fixed to the swing bars 204a, 204b, respectively, and have tapered edges 208a, 208b (see FIG. 9), respectively, on their distal ends.

The insertion conveyor 144 serves to support one, at a time, of products 20 that are successively delivered from a product stock 210 (see FIG. 1), and feeds the supported product 20 in the direction indicated by the arrow C after the insertion conveyor 144 is elevated. As shown in FIG. 9, the insertion conveyor 144 has an endless belt 216 which is actuated to travel in a circulatory path by a motor 212 through a belt and pulley mechanism 214. The endless belt 216 is supported on a pair of vertical sliders 217a, 217b that is vertically movable with respect to a horizontal fixed plate 215 between a loading position, indicated by the two-dot-and-dash lines in FIG. 9, for receiving a product 20 from the product stock 210 and an unloading position, indicated by the solid lines in FIG. 9, for delivering the product 20 into a gusseted package 12.

A horizontal joint plate 220 is fixed to lower ends of the sliders 217a, 217b, and coupled to an upper end of a cam rod 222 which is vertically movable by a cam mechanism (described later on). Cylinders 224a, 224b are mounted on the fixed plate 215 for normally urging the endless belt 216 upwardly. When no gusset package 12 is in a product insertion position, the cylinders 224a, 224b pulls the endless belt 216 downwardly to prevent the product 20 on the endless belt 216 from being lifted up to the unloading position.

Figure 15:
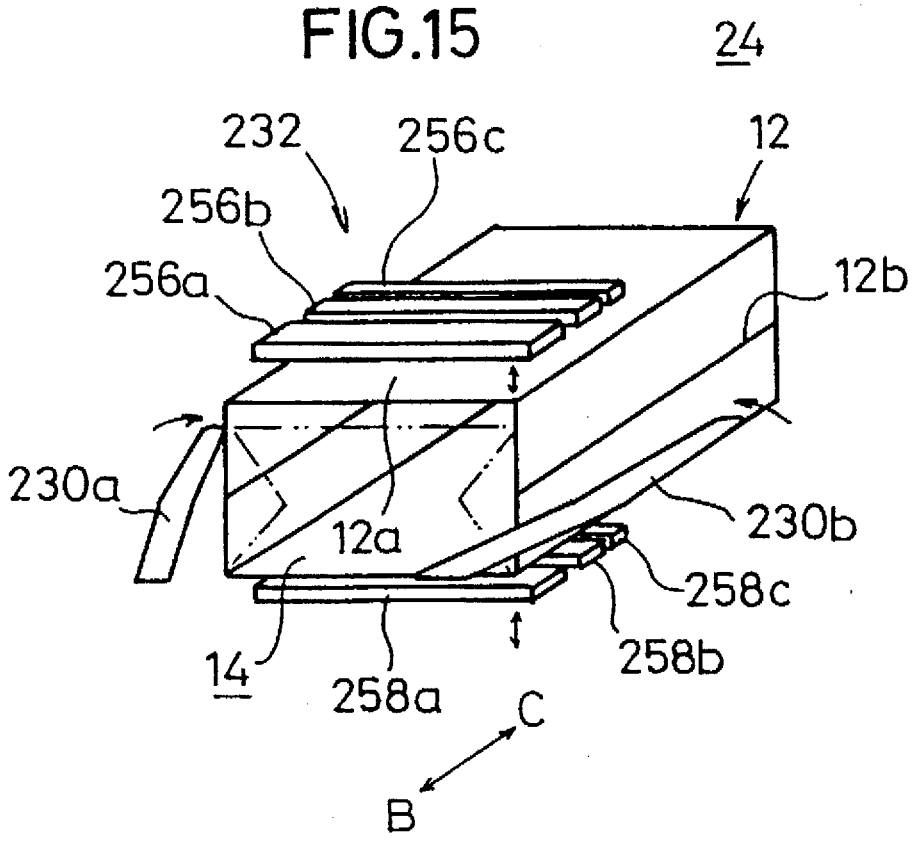
FIG. 15 is a perspective view of an open end forming mechanism of the packaging and sealing apparatus.

As shown in FIGS. 1 and 15, the open end forming mechanism 24 comprises a pair of first and second forming arms 230a, 230b disposed one on each side of a gusseted package 12 and angularly movable horizontally toward each other for folding respective opposite side gussets 12b of the gusseted package 12 inwardly into the gusseted package 12, and a closing device 232 for closing the open end 12a of the gusseted package 12 whose gussets 12b have been folded by the first and second forming arms 230a, 230b.

Figure 16:
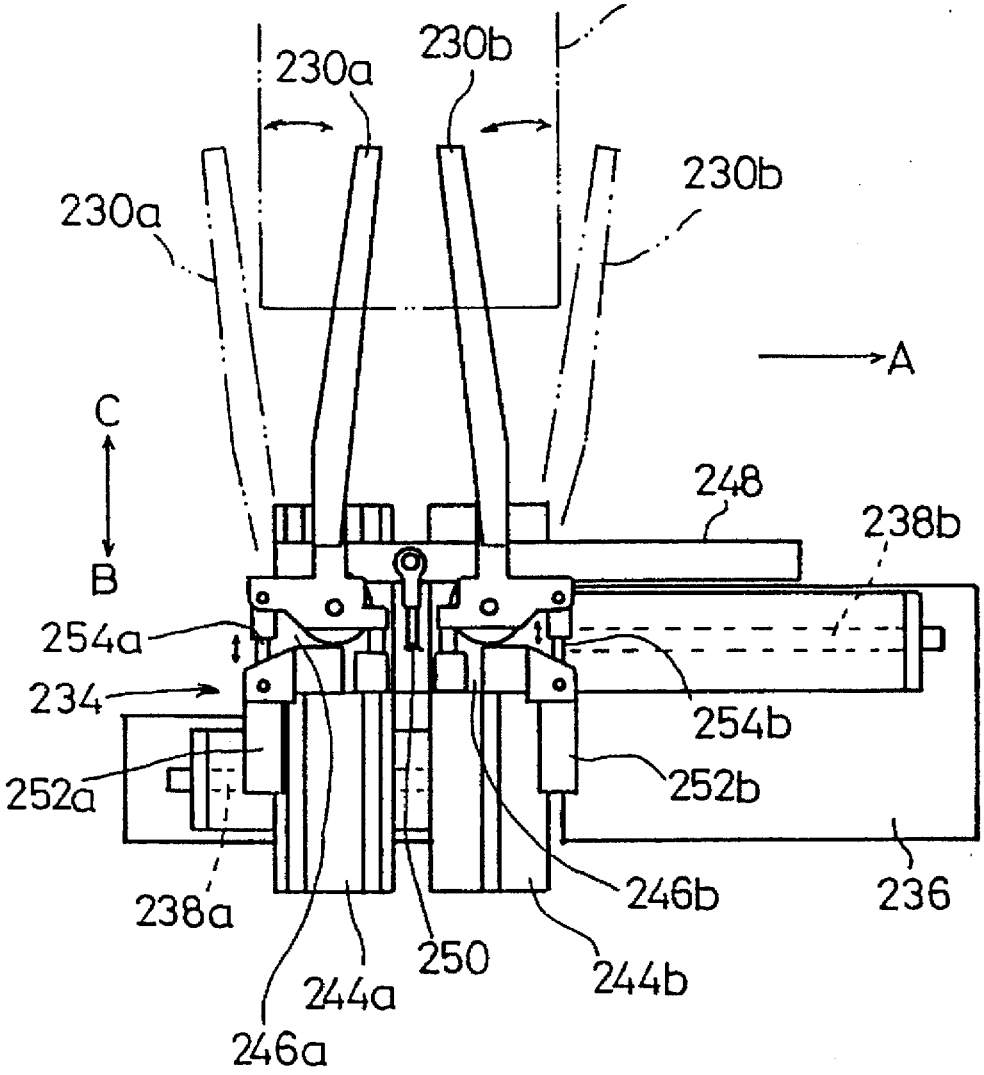
FIG. 16 is a plan view of an actuator device for a pair of first and second forming arms of the open end forming mechanism.
Figure 17:
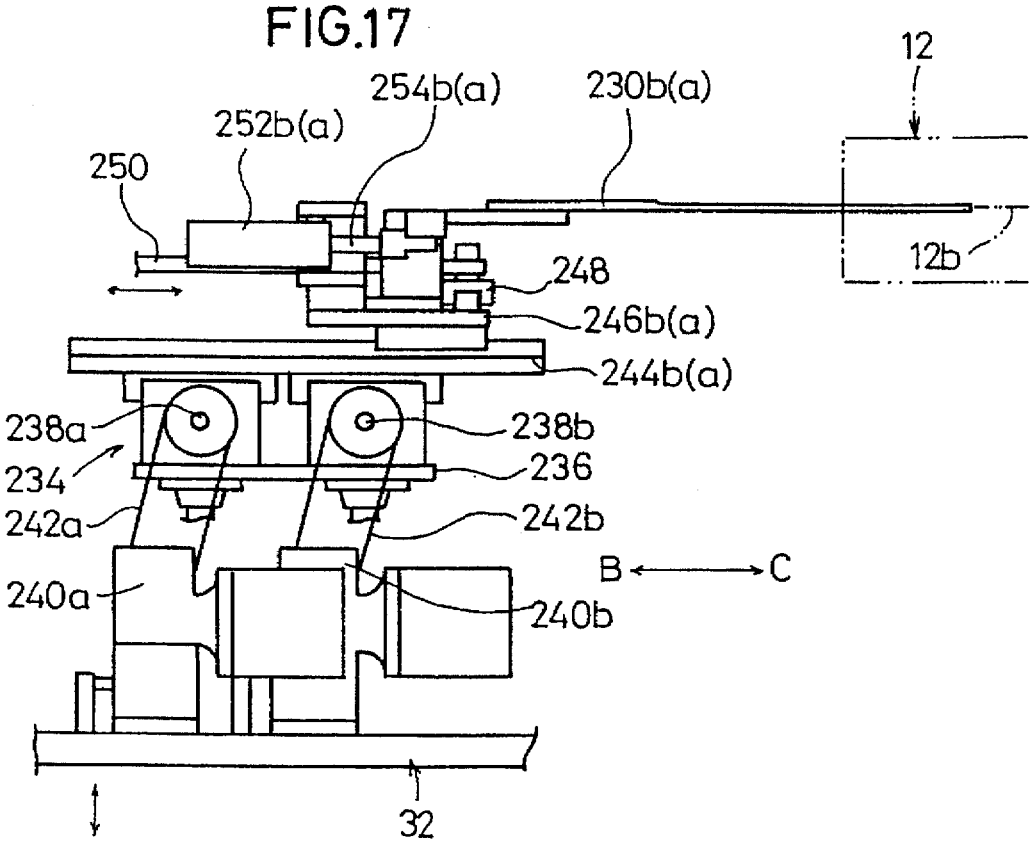
FIG. 17 is a side elevational view of the actuator device.

As shown in FIGS. 16 and 17, the open end forming mechanism 24 has an actuator device 234 for adjusting the distance between the first and second forming arms 230a, 230b depending on the size or dimension of the gusseted package 12. The actuator device 234 has a base 236 mounted on the movable block 32 and supporting thereon a pair of rotatable first and second ball screws 238a, 238b both extending in the direction indicated by the arrow A. Specifically, the first and second ball screws 238a, 238b extend parallel to each other and are axially displaced in position relatively to each other in the direction indicated by the arrow A. The first and second ball screws 238a, 238b are operatively coupled by respective belt-and-pulley mechanisms 242a, 242b to respective motors 240a, 240b which are mounted on the movable block 32. First and second movable rails 244a, 244b are held in threaded engagement with the first and second ball screws 238a, 238b.

First and second moving bases 246a, 246b are disposed on the first and second movable rails 244a, 244b, respectively, and interconnected by a horizontal joint plate 248 which is engaged by a cam rod 250. First and second cylinders 252a, 252b are swingably mounted respectively on the first and second moving bases 246a, 246b and have respective rods 254a, 254b engaging respective rear ends of the first and second forming arms 230a, 230b that are supported respectively on the first and second moving bases 246a, 246b.

As shown in FIG. 15, the closing device 232 comprises a pair of first upper and lower grip plates 256a, 258a for vertically sandwiching the open end 12*a* of the gusseted package 12, a pair of second upper and lower grip plates 256*b*, 258*b* for vertically sandwiching the open end 12*a* of the gusseted package 12 at a position inward of the position where the first upper and lower grip plates 256*a*, 258*a* sandwich the open end 12*a* of the gusseted package 12, and a pair of third upper and lower grip plates 256*c*, 258*c* for vertically sandwiching the open end 12*a* of the gusseted package 12 for vertically sandwiching the open end 12*a* of the gusseted package 12 at a position inward of the position where the second upper and lower grip plates 256*b*, 258*b* sandwich the open end 12*a* of the gusseted package 12, the third upper and lower grip plates 256*c*, 258*c* being movable, while sandwiching the open end 12*a* of the gusseted package 12, along the conveyor 16 to a position corresponding to the folding mechanism 28.

Figure 18:
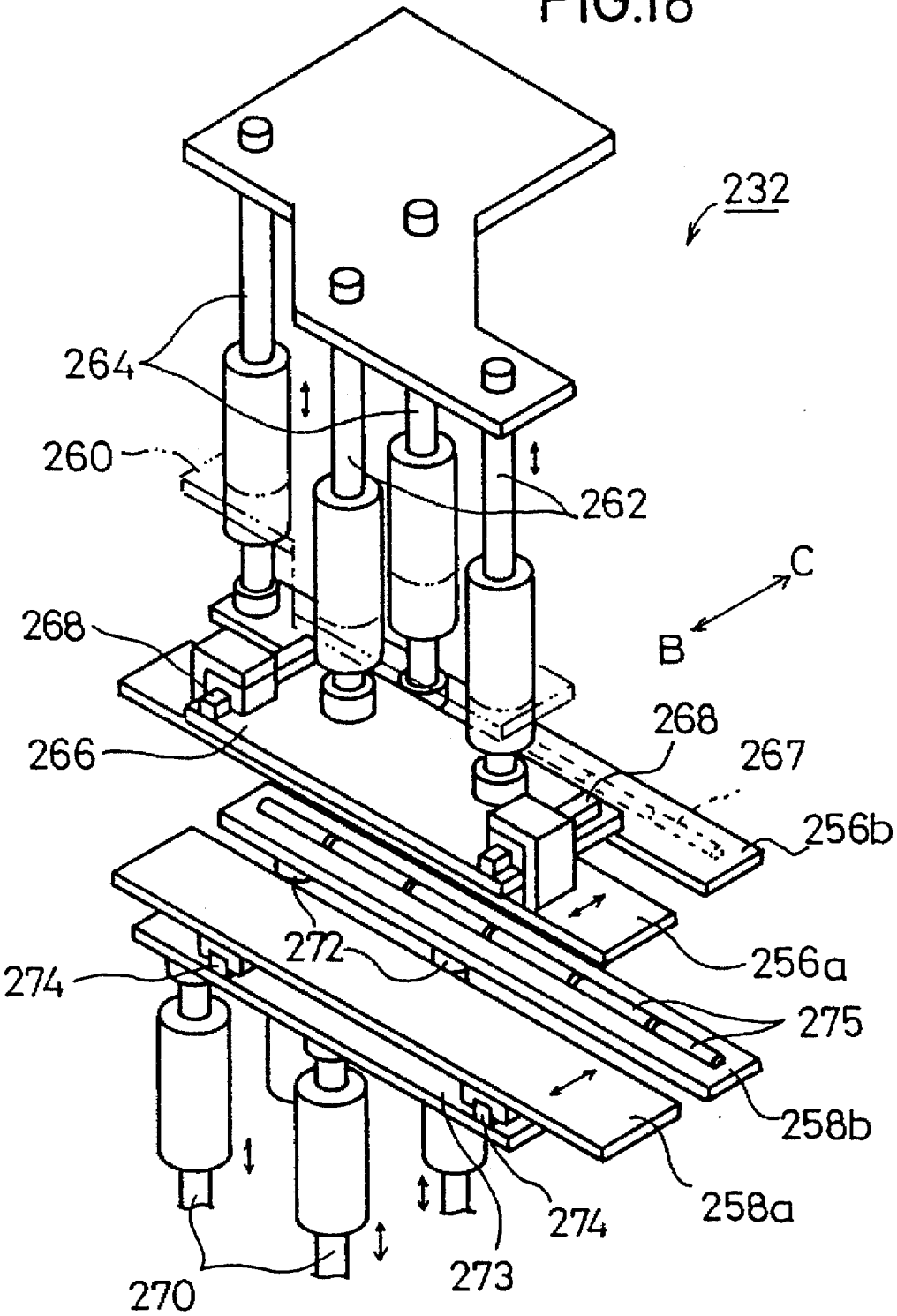
FIG. 18 is a perspective view of a closing device of the open end forming mechanism.
Figure 19:
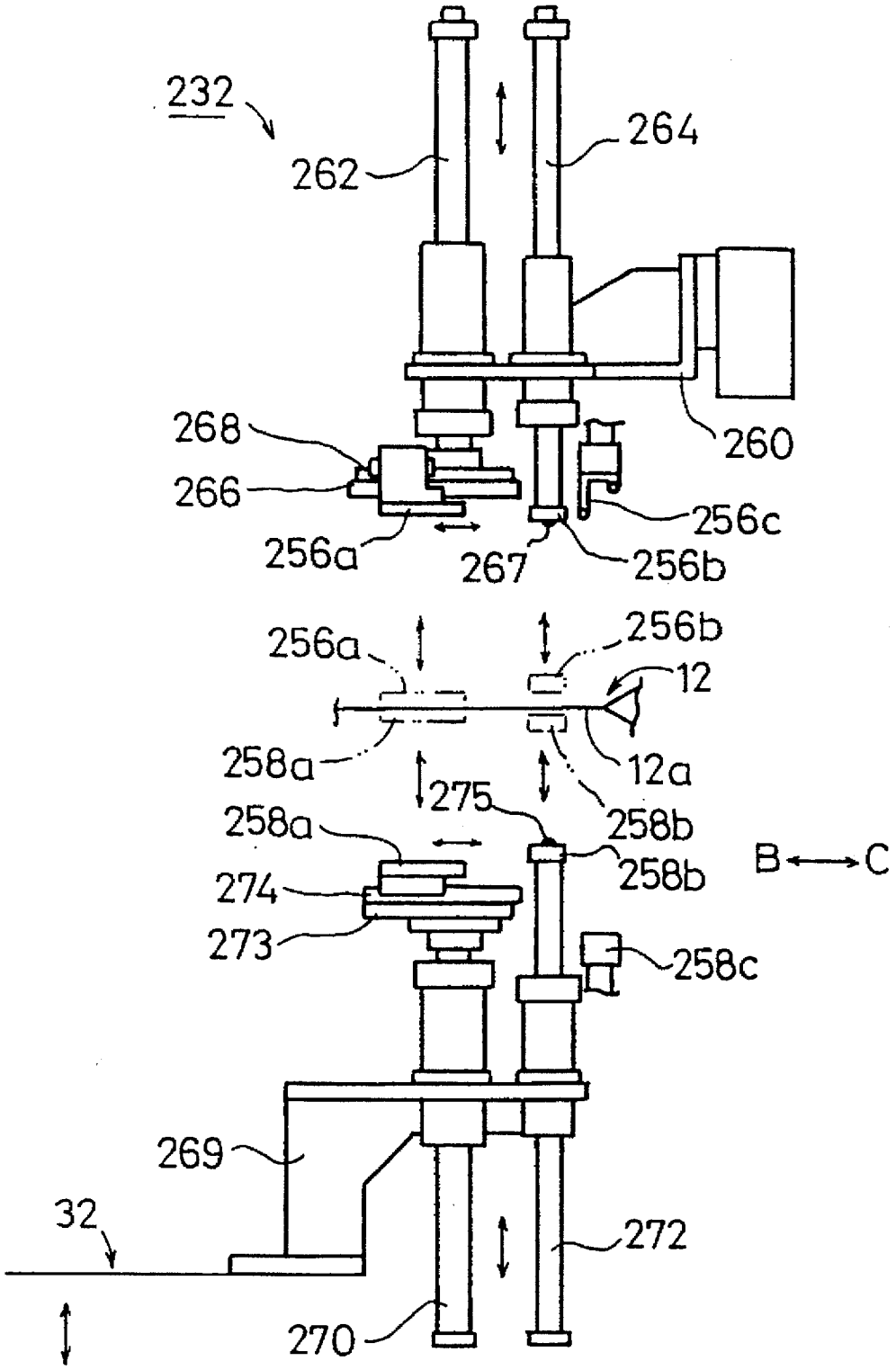
FIG. 19 is a side elevational view of the closing device.

As shown in FIGS. 18 and 19, the closing device 232 has an upper support plate 260, pairs of upper sliders 262, 262 fixedly mounted on the upper support plate 260, and a plate 266 fixed to lower ends of the paired upper sliders 262. A pair of parallel guide rails 268 extending in the directions indicated by the arrows B, C is mounted on the plate 266, and the first upper grip plate 256*a* is supported on the guide rails 268 for back-and-forth movement therealong for a predetermined distance.

The second upper grip plate 256*b*, which is narrower than the first upper grip plate 256*a*, is fixed to lower ends of the paired upper sliders 264. An array of rollers 267 is disposed on a lower surface of the second upper grip plate 256*b*.

A lower support plate 269 is positioned in vertically confronting relation to the upper support plate 260, and pairs of lower sliders 270, 272 are supported on the lower support plate 269. A plate 273 is fixed to upper ends of the lower sliders 270, and supports a pair of guide rails 274 thereon. The first lower grip plate 258*a* is mounted on the guide rails 274 for displacement therealong in the directions indicated by the arrows B, C.

The second lower grip plate 258*b*, which is narrower than the first lower grip plate 258*a*, is fixed to lower ends of the paired upper sliders 272. An array of rollers 275 is disposed on an upper surface of the second lower grip plate 258*b*.

Figure 20:
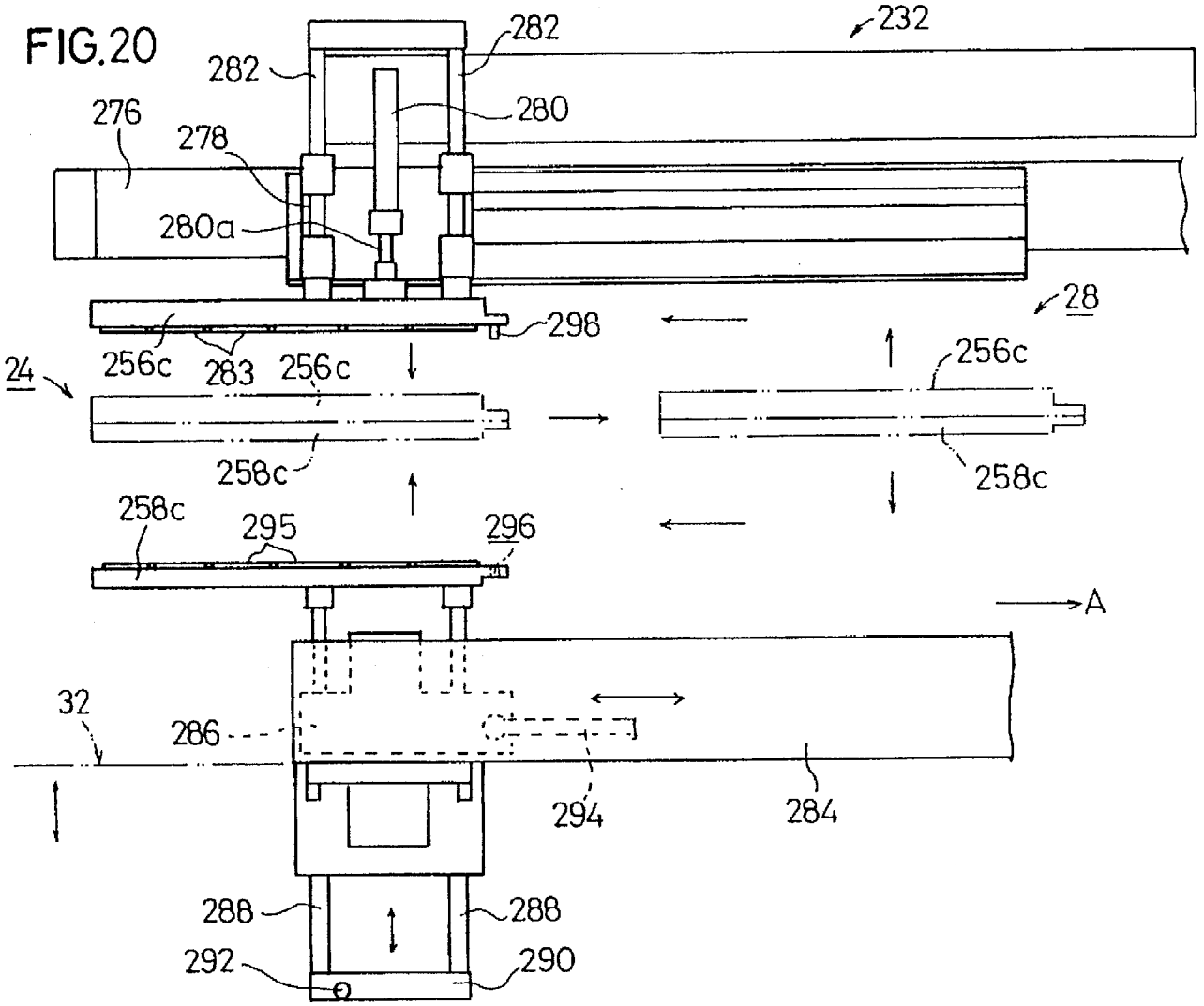
FIG. 20 is a front elevational view of an actuator mechanism for third upper and lower grip plates of the closing device.

As shown in FIG. 20, the closing device 232 has an upper rail 276 extending in the direction indicated by the arrow A from the open end forming mechanism 24 to a position corresponding to the folding mechanism 28. An upper moving base 278 is disposed on the upper rail 276. The upper moving base 278 has a cam actuator (not shown), and is movable in a direction opposite to the direction indicated by the arrow A along the upper rail 276.

To the upper moving base 278, there is affixed a vertically extending cylinder 280 having a rod 280*a* extending downwardly therefrom with the third upper grip plate 256*c* secured thereto. A pair of vertical guide rods 282 is fixedly mounted on the third upper grip plate 256*c*. An array of rollers 283 is mounted on a lower surface of the third upper grip plate 256*c*.

The closing device 232 also has a lower rail 284 disposed on the movable block 32 below the upper rail 278 and extending in the direction indicated by the arrow A. A lower moving base 286 is supported on the lower rail 284. A pair of vertical rods 288 is vertically movably inserted in the lower moving base 286, and the third grip plate 258*c* is fixed to upper ends of the rods 288. A cam roller 292 is fixed to a plate 290 which is attached to lower ends of the rods 288. A cam rod 294 engages a side of the lower moving base 286, which is movable back and forth in the direction indicated by the arrow A through the cam rod 294.

An array of rollers 295 is mounted on an upper surface of the third lower grip plate 258*c*. The third lower grip plate 258*c* has a hole 296 defined in an end thereof, and the third upper grip plate 256*c* has an engaging pin 298 mounted on an end thereof for fitting engagement in the hole 296.

As shown in FIG. 1, the folding mechanism 28 has first through third folding stations 300, 302, 304 successively arranged in the direction indicated by the arrow A along the conveyor 16, for folding back the open end 12*a* of a gusseted package 12, about 180° three times into a folded end 26, a feeder device 306 for feeding the open end 12*a* of the gusseted package 12, while keeping it folded, to the second folding station 302, the third folding station 304, and a position corresponding to the sealing mechanism 30.

Figure 21:
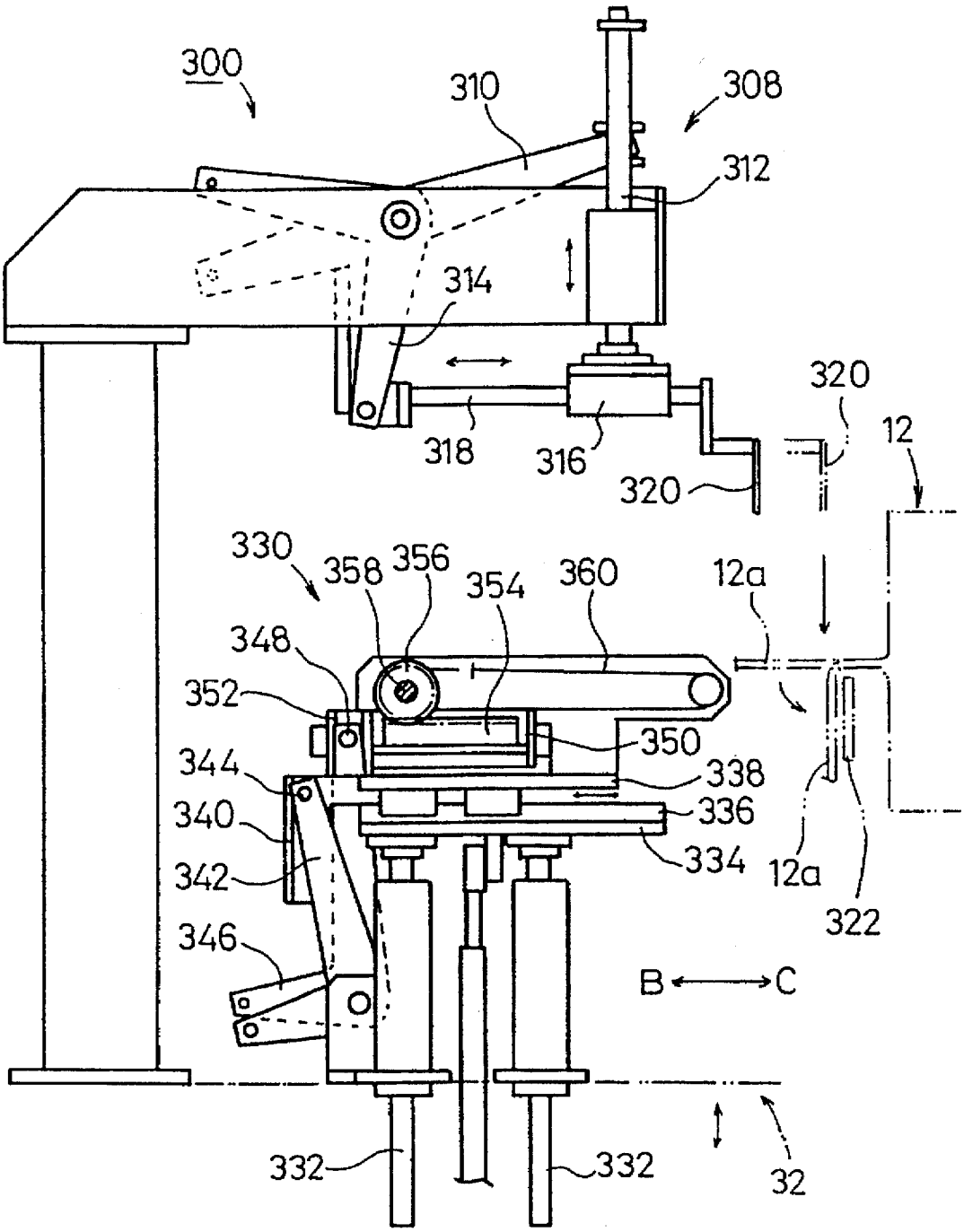
FIG. 21 is a side elevational view of a first folding station of a folding mechanism of the packaging and sealing apparatus.
Figure 22:
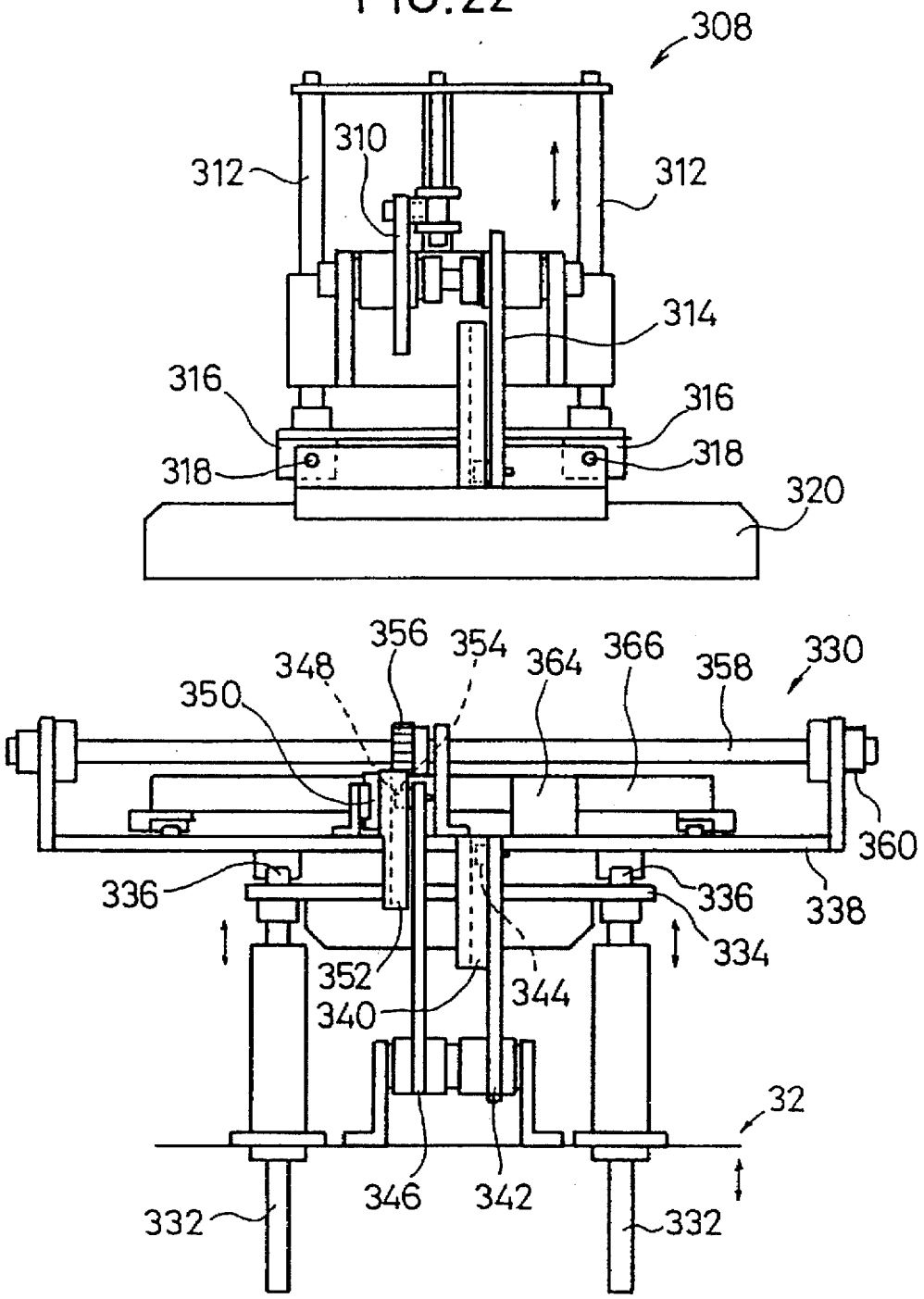
FIG. 22 is a front elevational view of the first folding station.

The first folding station 300 has a folding device 308 disposed on the movable block 32, for folding vertically downwardly the open end 12*a* of the gusseted package 12 which extends horizontally. As shown in FIGS. 21 and 22, the folding device 308 comprises a pair of support rods 312 vertically movable by a first cam 310, and a horizontal rod 318 horizontally movable back and forth by a second cam 314 and supported for its horizontal back-and-forth movement by a guide 316 mounted on lower ends of the support rods 312. A movable folding plate 320 which extends vertically is fixed to a distal end of the horizontal rod 318. A fixed folding plate 322 which extends vertically is disposed in a given position below the movable folding plate 320.

Figure 23:
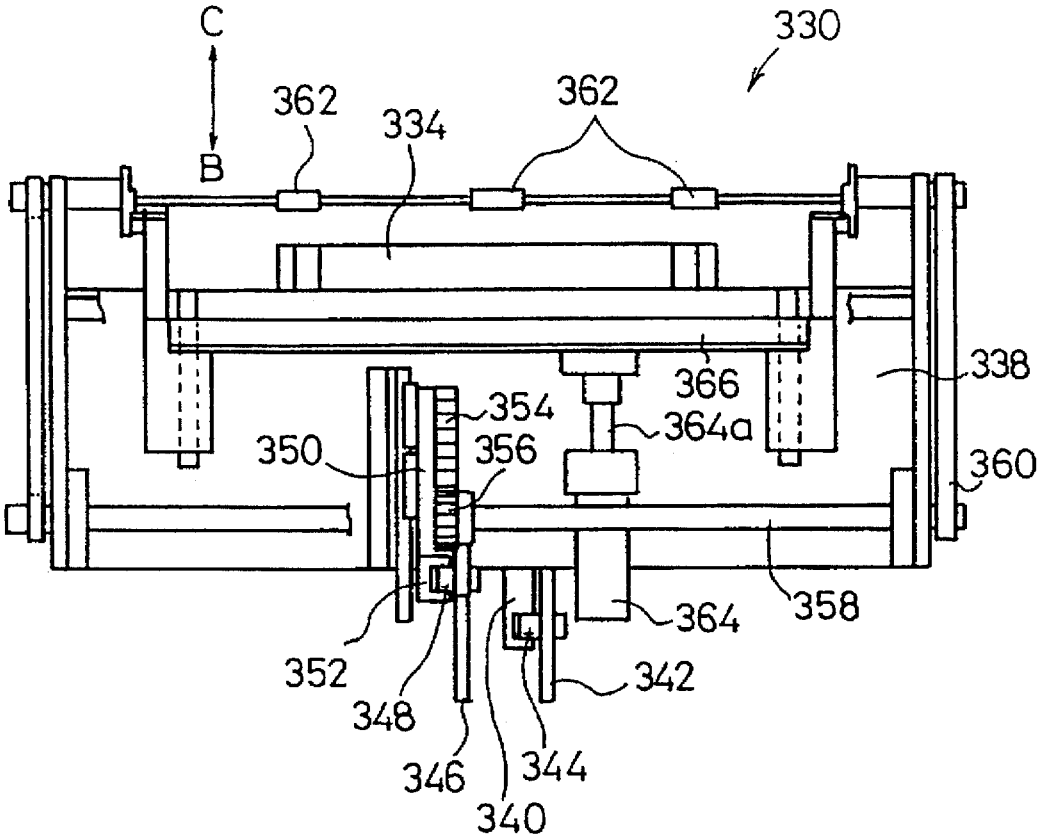
FIG. 23 is a plan view of a first folder in the first folding station.

As shown in FIGS. 21 through 23, the first folding station 300 has a first holder 330 which comprises a plurality of (four) sliders 332 fixedly mounted on the movable block 32 and a vertically movable plate 334 supported on upper ends of the sliders 332. The vertically movable plate 334 supports a pair of guide rails 336 fixed thereto on which a slide 338 is mounted for back-and-forth movement in the directions indicated by the arrows B, C. A vertical guide 340 is fixed to an end of the slide 338 and engaged by a roller 344 which is fixed to an end of a first swing cam 342.

The first swing cam 342 is flanked with a second swing cam 346, and a roller 348 fixed to an end of the second swing cam 346 engages a vertical guide 352 which is fixed to a slider 350. To the slider 350, there is fixed a rack 354 extending in the directions indicated by the arrows B, C and held in mesh with a pinion 356 fixedly mounted on a rotatable shaft 358 which is operatively coupled to first folding plates 362 through belt and pulley mechanisms 360. The first folding plates 362 are normally urged into a closed position by a spring (not shown). The first folding plates 362 engage a presser plate 366 fixed to a rod 364*a* +lwhich extends from a cylinder 364 mounted on the slide 338. The first folding plates 362 can forcibly be opened by the presser plate 366 when the presser plate 366 is moved.

Figure 24:
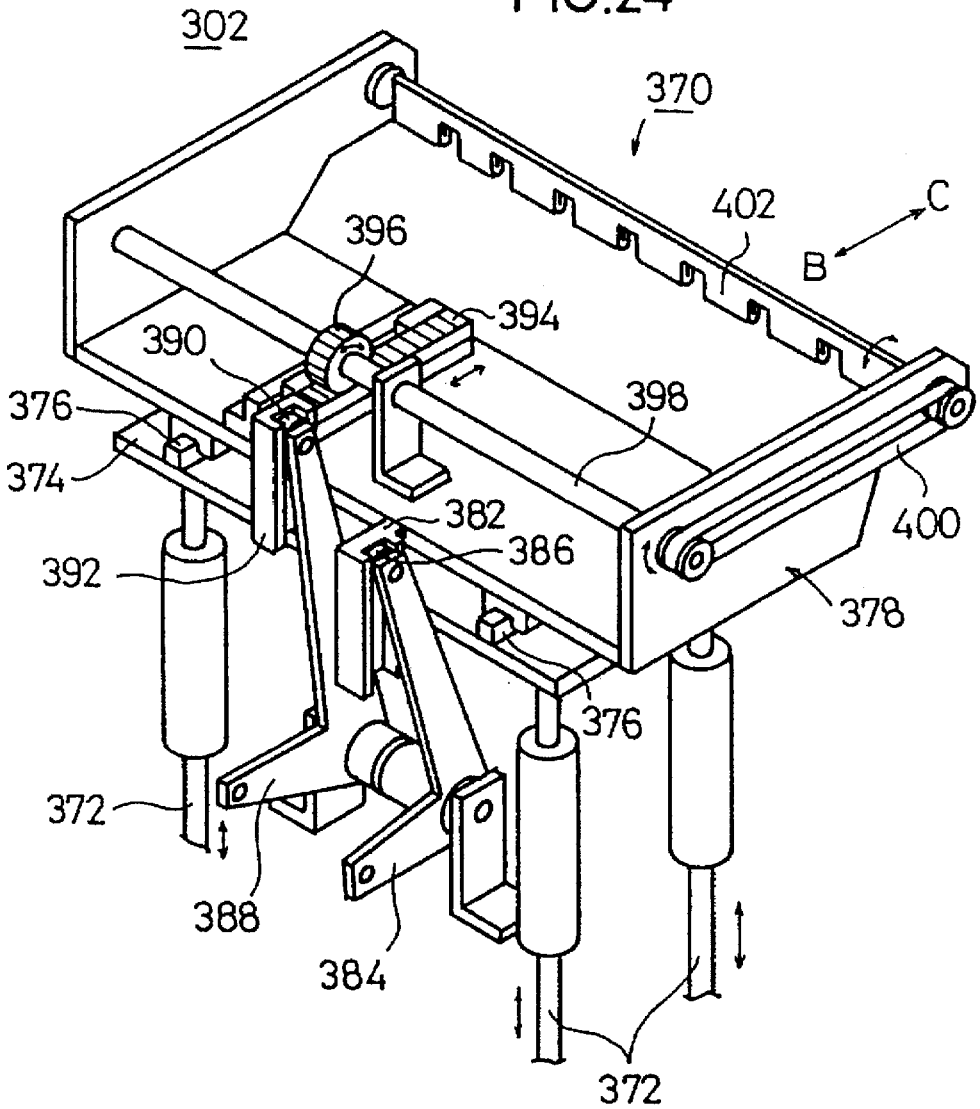
FIG. 24 is a perspective view of a second folder in a second folding station of the folding mechanism.

As shown in FIG. 24, the second folding station 302 has a second folder 370 which is of substantially the same structure as the first folder 330. The second folder 370 has a vertically movable plate 374 fixed to upper ends of a plurality of sliders 372, and a slide 378 mounted for back-and-forth movement on guide rails 376 fixed to the vertically movable plate 374.

A roller 386 mounted on an end of a first swing cam 384 engages a vertical guide 382 which is fixed to an end of the slide 378. The first swing cam 384 is flanked with a second swing cam 388, and a roller 390 fixed to an end of the second swing cam 388 engages a vertical guide 392 which holds a rack 392 held in mesh with a pinion 396. The pinion 396 is fixedly mounted on a rotatable shaft 398 which is operatively coupled to a plurality of spaced second folding plates 402 through belt and pulley mechanisms 400. Each of the second folding plates 402 has a bent tip end.

Figure 25:
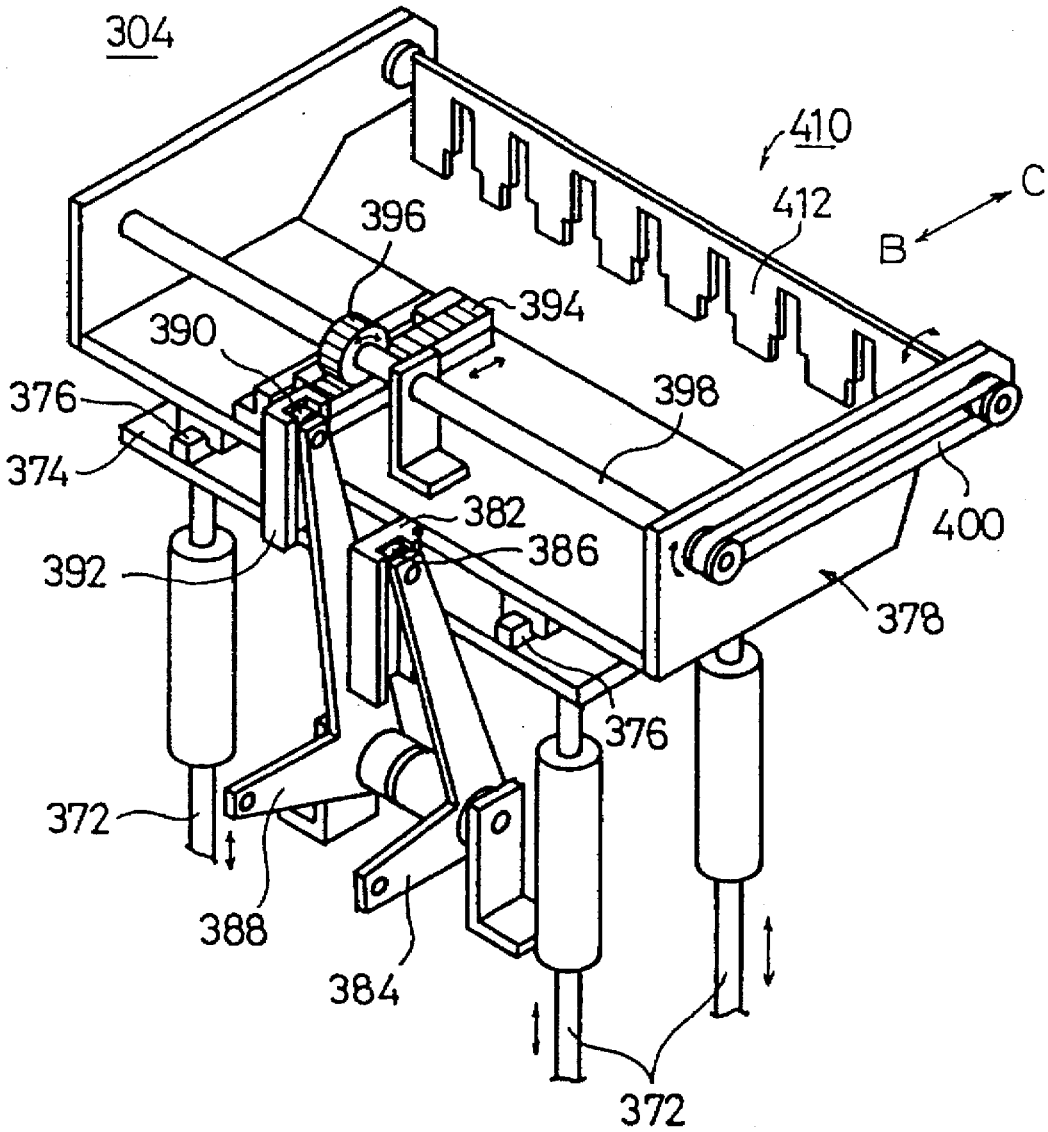
FIG. 25 is a perspective view of a third folder in a third folding station of the folding mechanism.

As shown in FIG. 25, the third folding station 304 has a third folder 410 which is of substantially the same structure as the second folder 370. Those parts of the third folder 410 which are identical to those of the second folder 370 are denoted by identical reference numerals, and will not be described in detail below. The third folder 410 has a plurality of third folding plates 412 whose widths and spaced intervals are selected as desired.

Figure 26:
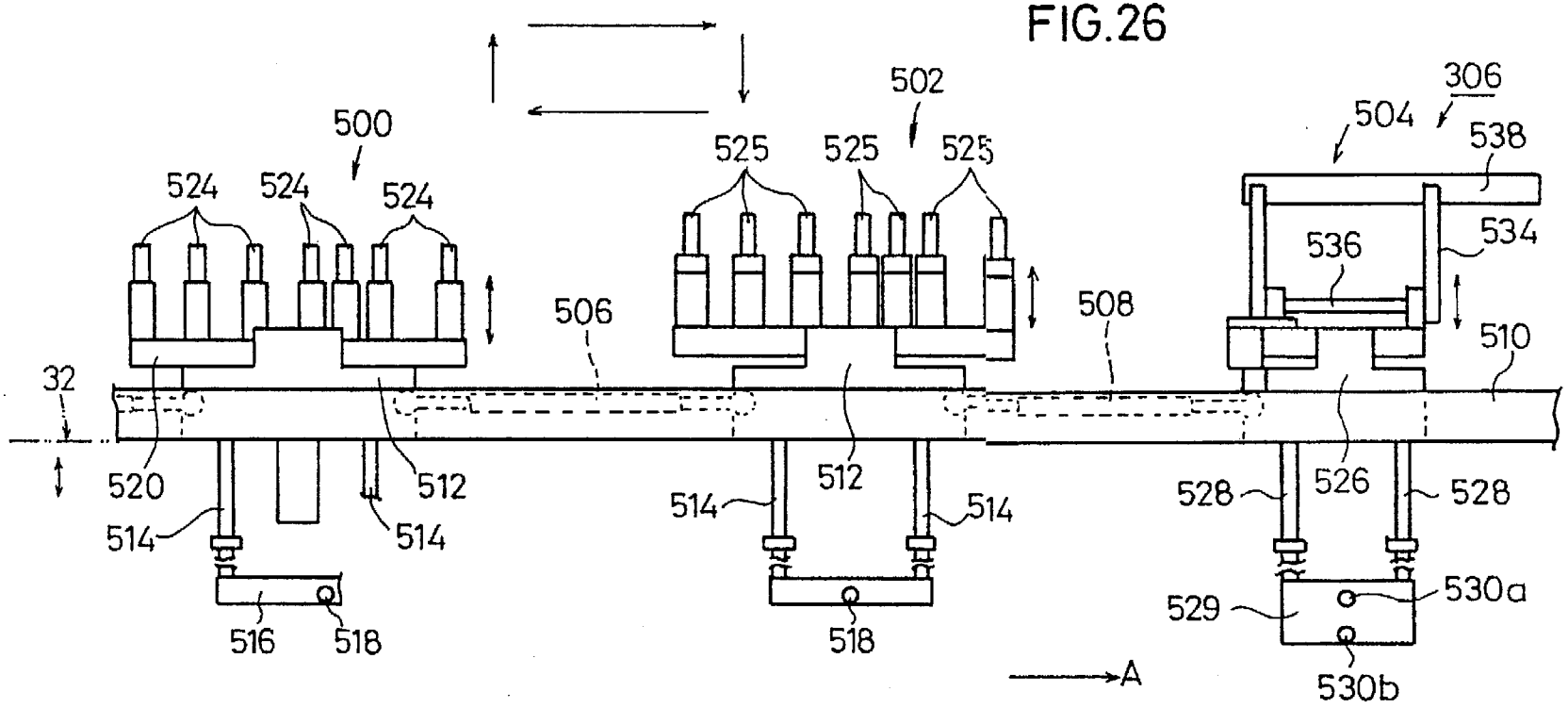
FIG. 26 is a front elevational view of a feeder device of the folding mechanism.

As shown in FIG. 26, the feeder device 306 comprises a first feed chuck 500, a second feed chuck 502, and a third feed chuck 504 which are movable back and forth in unison with each other along a guide rail 510 extending in the direction indicated by the arrow A, through joint bars 506, 508. The guide rail 510 is fixedly mounted on the movable block 32.

Figure 27:
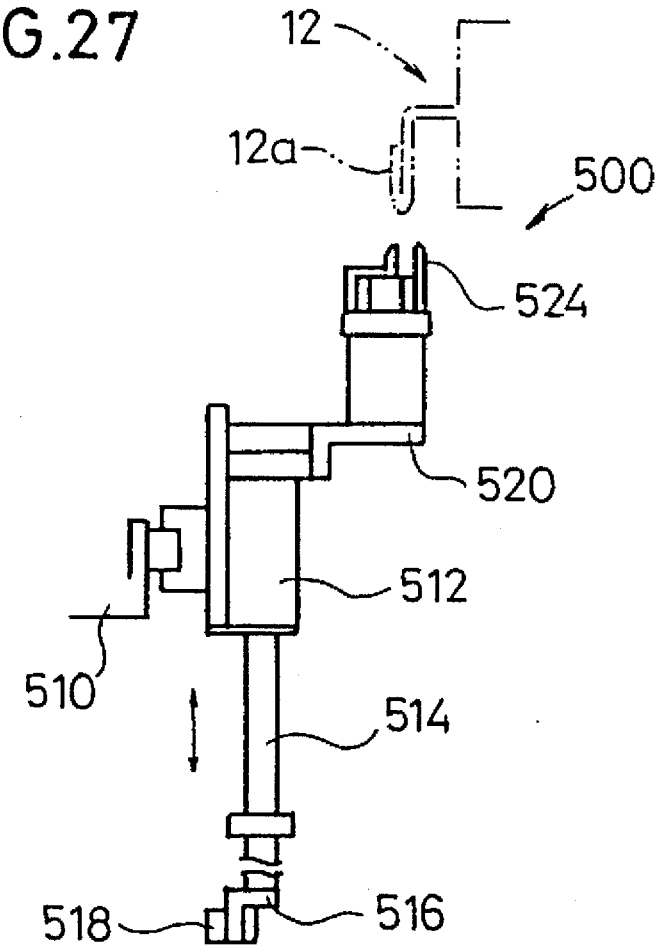
FIG. 27 is a side elevational view of a first feed chuck of the feeder device.

As shown in FIGS. 26 and 27, the first feed chuck 500 has a moving base 512 supported on the guide rail 510 and a pair of vertical rods 514 inserted through the moving base 512. A cam 518 is mounted on a joint plate 516 which is connected to lower ends of the vertical rods 514. A plurality of first chucks 524 for gripping the open end 12*a*, which has been folded back once, of a gusseted package 12 are mounted on upper ends of the vertical rods 512 by an attachment base 520 at given spaced intervals.

The second feed chuck 502 is of substantially the same structure as the first feed chuck 500. Those parts of the second feed chuck 502 which are identical to those of the first feed chuck 500 are denoted by identical reference numerals, and will not be described in detail below. The second feed chuck 502 has a plurality of chucks 525 for gripping the open end 12*a*, which has been folded back twice, of a gusseted package 12.

Figure 28:
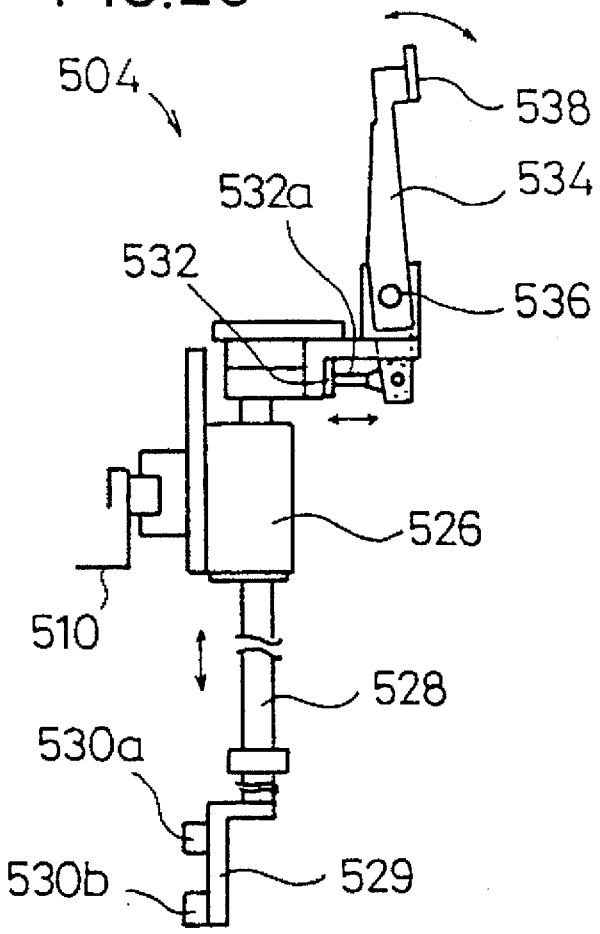
FIG. 28 is a side elevational view of a third feed chuck of the feeder device.
Figure 29:
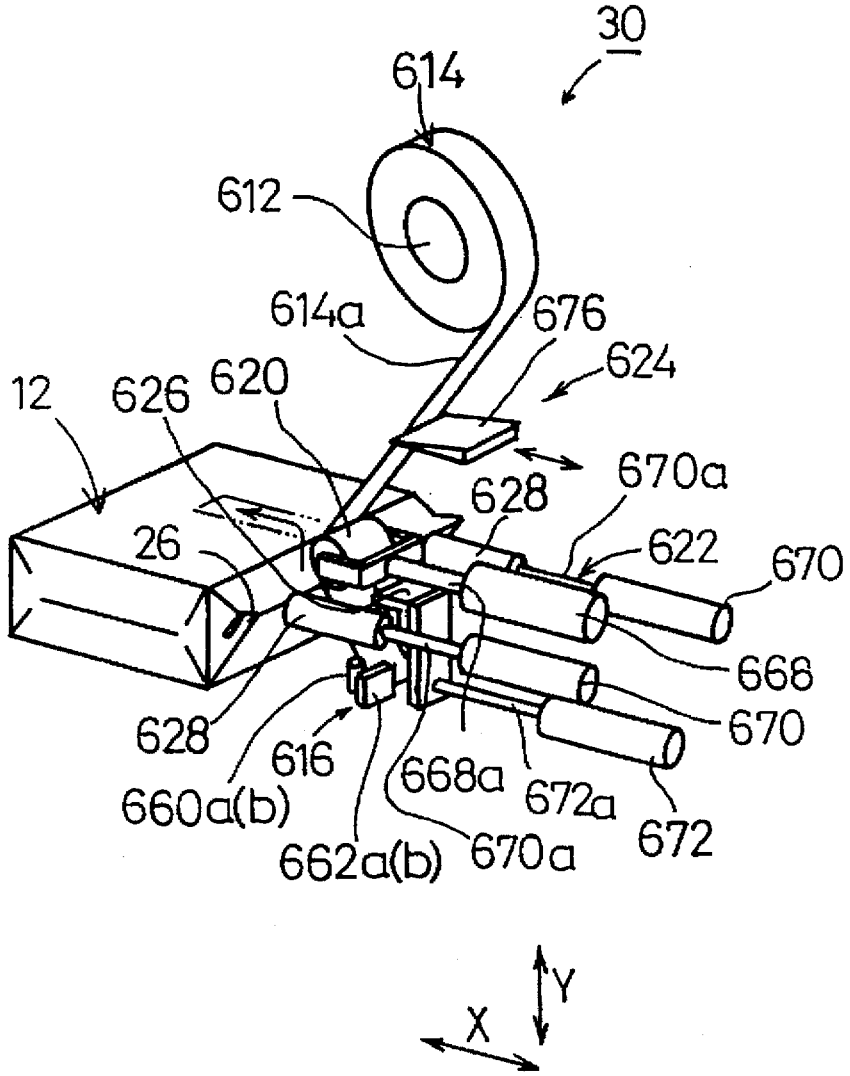
FIG. 29 is a perspective view of a sealing mechanism of the packaging and sealing apparatus.

As shown in FIGS. 26 and 28, the third feed chuck 504 has a moving base 526 supported on the guide rail 510 and a pair of vertical rods 528 inserted through the moving base 526. A cam 530*a* is disposed on a joint plate 529 which is connected to lower ends of the vertical rods 528, and a cam follower 530*b* connected to a cylinder (not shown) is mounted on the joint plate 529 below the cam 530*a*. The cam follower 530*b* allows the third feed chuck 504 to be vertically moved by the non-illustrated cylinder independently of the first and second feed chucks 500, 502. A cylinder 532 is mounted on upper ends of the vertical rods 528 and has a horizontal rod 532*a* coupled to lower ends of a pair of swing arms 534 for angularly moving about a pivot shaft 536 a presser plate 538 as a third chuck that is joined to upper ends of the swing arms 534.

As shown in FIGS. 1 and 29 through 31, the sealing mechanism 30 comprises a tape drawing device 616 for gripping a leading end of a one-sided adhesive tape 614 wound on a tape reel 612 and drawing a predetermined length of the adhesive tape 614, a bonding roller 620 for pressing an adhesive surface 612*a* of the adhesive tape 614 drawn by the tape drawing device 616 against a gusseted package 12, a moving device 622 for moving the bonding roller 620 in mutually crossing two directions, i.e., the directions indicated by the arrows X, Y, depending on the shape of the gusseted package 12, a cutter device 624 for cutting off the adhesive tape 614 at a desired position thereon, a bonding member 626 for applying the leading end of the drawn adhesive tape 614 to the gusseted package 12, and a pair of pressers 628 for pressing and supporting the folded end 26 of the gusseted package 12.

Figure 30:
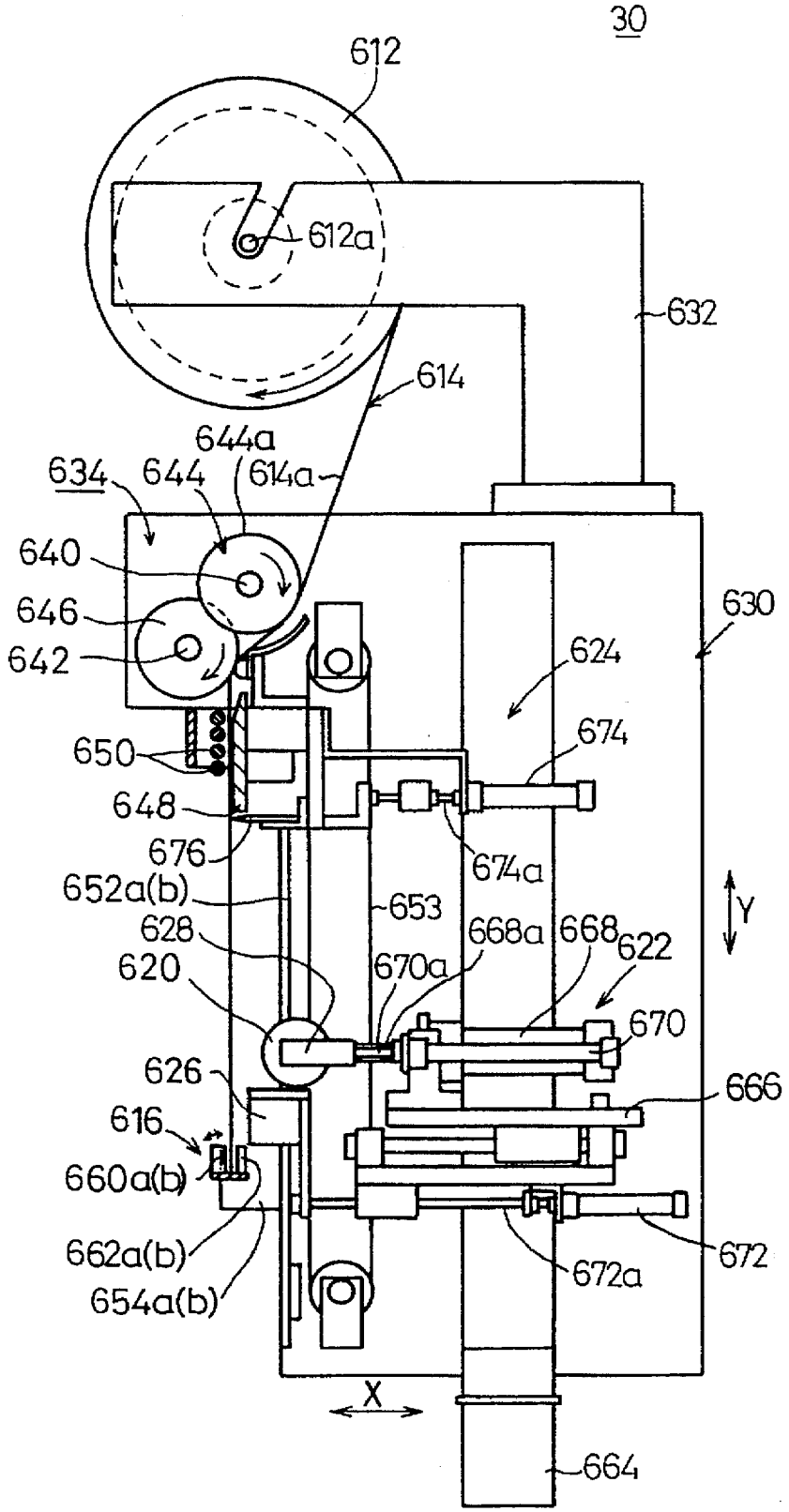
FIG. 30 is a side elevational view of the sealing mechanism.
Figure 31:
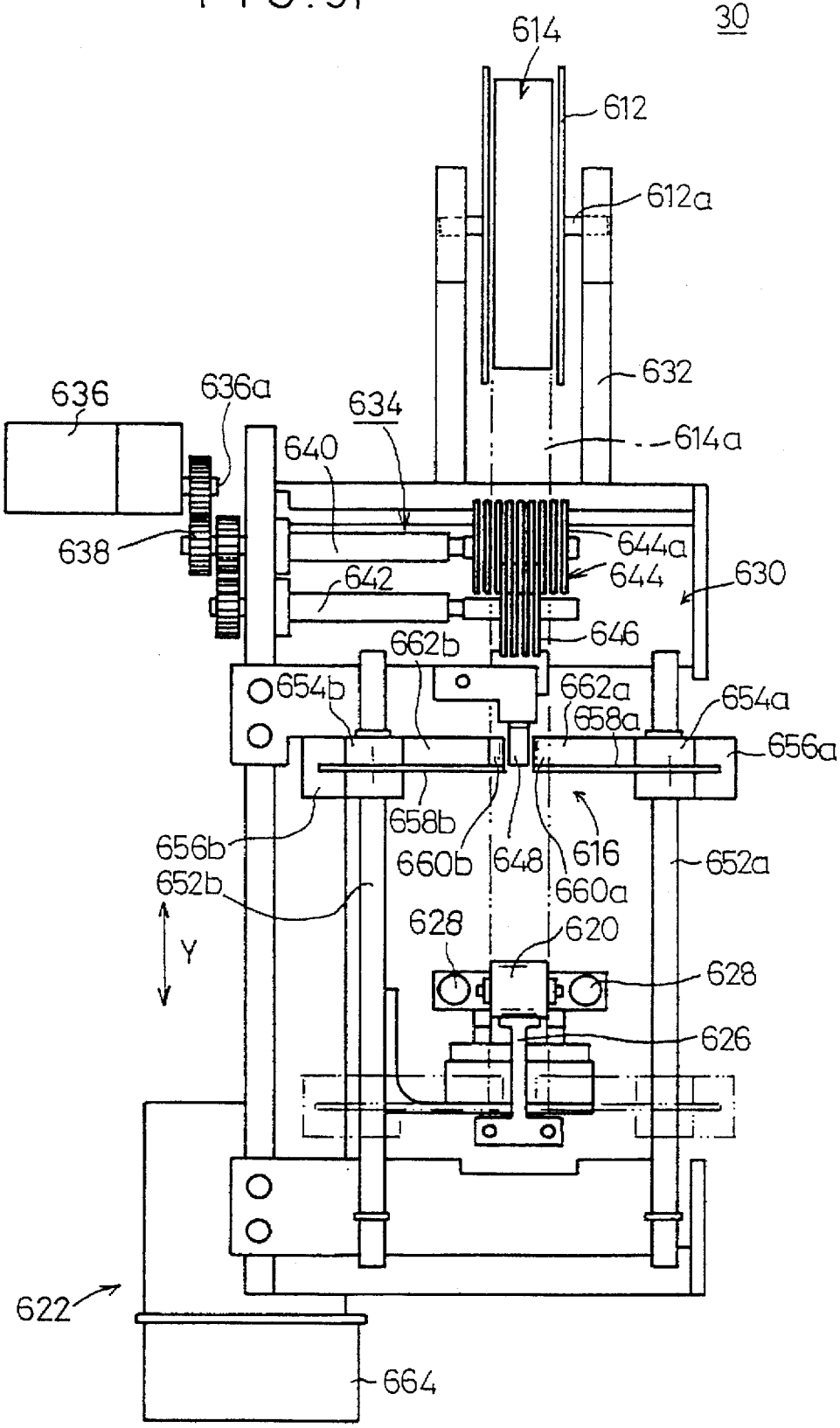
FIG. 31 is a front elevational view of the sealing mechanism.

As shown in FIGS. 30 and 31, the sealing mechanism 30 has a frame 630 with a pair of spaced arms 632 mounted on an upper surface thereof. The tape reel 612 has a shaft 612*a* rotatably and removably supported by the arms 632. A tape unreeling device 634 is supported on the frame 630 below the tape reel 612.

The tape unreeling device 634 comprises a motor 636 having a rotatable shaft 636*a* which is operatively coupled through a gear train 638 to first and second rotatable shafts 640, 642 for rotating them in one direction. The first rotatable shaft 640 supports thereon a plurality of thin feed rollers 644 spaced at given intervals. The feed rollers 644 comprise rollers of metal and have knurled surfaces 644*a* on their circumferences for engaging the adhesive surface 614*a* of the adhesive tape 614 to forcibly unreel the adhesive tape 614 positively from the tape reel 612.

The second rotatable shaft 642 supports thereon a plurality of resin rollers 646 spaced at given intervals. The resin rollers 646 are made of Teflon, for example, and axially alternate with and radially overlap the feed rollers 644 for preventing the adhesive tape 614 from being entangled by the feed rollers 644.

A vertical guide plate 648 is disposed on the frame 630 near the tape unreeling device 634, and confronted by a vertical array of guide rollers 650 of Teflon. The adhesive tape 614 is guided through a gap defined between the guide plate 648 and the guide rollers 650.

The tape drawing device 616 has a pair of vertical guide rails 652*a*, 652*b* and a pair of vertically movable bases 654*a*, 654*b* vertically movably supported on the respective vertical guide rails 652*a*, 652*b* through a belt and pulley mechanism 653. Horizontal cylinders 656*a*, 656*b* are fixed to the vertically movable bases 654*a*, 654*b*, respectively, and have respective piston rods (not shown) to which ends of swing plates 658*a*, 658*b* are joined.

The swing plates 658*a*, 658*b* are angularly movable about positions corresponding to the guide rails 652*a*, 652*b*, and support respective chuck rollers 660*a*, 660*b* of Teflon on other ends thereof. Chuck plates 662*a*, 662*b* are fixed to the swing plates 658*a*, 658*b*, respectively, in confronting relation to the chuck rollers 660*a*, 660*b*.

As shown in FIG. 30, the moving device 622 comprises a servomotor 664 and a vertically movable base 666 engaging a ball screw (not shown) coupled to and extending upwardly from the servomotor 664. A first drive cylinder 668 is fixed to the vertically movable base 666 and has a horizontal rod 668*a* on which the bonding roller 620 is rotatably mounted.

On the vertically movable base 666, there is mounted a pair of second drive cylinders 670 positioned one on each side of the first drive cylinder 668 and having respective horizontal rods 670*a* to which the respective pressers 628 are fixed. A third drive cylinder 672 is disposed beneath the vertically movable base 666 and has a horizontal rod 672*a* on which the bonding member 626 is mounted. The bonding member 626 comprises a substantially T-shaped plate having an upper end lying substantially flush with the lower end of the bonding roller 620.

The cutter device 624 has a fourth drive cylinder 674 fixed in position behind the guide plate 648. The fourth drive cylinder 674 has a horizontal rod 674*a* on which a cutter 676 is supported.

As shown in FIG. 1, the fixed block 34 houses therein a cam mechanism 682 rotatable by a motor 680 for actuating the opening mechanism 18, the inserting mechanism 22, the open end forming mechanism 24, the folding mechanism 28, and the sealing mechanism 30 all in synchronism with the conveyor 16.

A presser plate 684 for pressing the upper surface of a gusseted package 12 is vertically movably disposed in each of the inserting mechanism 22, the open end forming mechanism 24, and the first through third folding stations 300, 302, 304 of the folding mechanism 28.

Operation of the packaging and sealing apparatus 10 of the above structure will be described below.

In FIG. 1, the conveyor 16 is intermittently actuated, and the motor 680 is energized to actuate the cam mechanism 682 in synchronism with the conveyor 16. A gusseted package 12 which has been charged into the package loader 44 is conveyed in the direction indicated by the arrow B by the rollers 52 while an end position thereof is being limited in the direction indicated by the arrow A by the positioning fingers 48, until the open end 12*a* is held against the positioning plate 50.

When the gusseted package 12 is thus positioned in the package loader 44, the feeder 54 is actuated to move the swing fingers 58, vertically oriented, in the direction indicated by the arrow A for thereby delivering the gusseted package 12 into the transfer device 46. The presser plate 68 is lowered to press the open end 12*a* of the gusseted package 12 against the lower suction belt 60, which attracts the open end 12*a* of the gusseted package 12.

The lower suction belt 60 is actuated in the direction indicated by the arrow A, and a suction mechanism (not shown) coupled thereto is actuated. Therefore, the gusseted package 12 which is attracted to the lower suction belt 60 is conveyed in the direction indicated by the arrow A, and thereafter stops at a position corresponding to the opening mechanism 18.

In the opening mechanism 18, the cam rod 105 is lowered together with the upper suction cups 102*a*≠102*d* of the suction device 70 by the cam mechanism 682, and the vertically movable frame 104 and the lower suction cups 100*a*≠100*d* are elevated in unison with each other by a cylinder or the like. The open end 12*a* of the gusseted package 12 is now attracted vertically by the upper suction cups 102*a*≠102*d* and the lower suction cups 100*a*≠100*d*. When the upper suction cups 102*a*≠102*d* are lowered, as shown in FIG. 4, the motor 114 of the bottom suction device 74 is energized to lower the vertically movable arm 116 and the suction cups 118 for thereby attracting the bottom 12*c* of the gusseted package 12.

Then, the upper suction cups 102*a*≠102*d* attract the upper surface of the open end 12*a* of the gusseted package 12, and are lifted to a vertical position corresponding to the height of the gusseted package 12 as it is opened, whereas the lower suction cups 100*a*≠100*d* attract the lower surface of the open end 12*a* of the gusseted package 12, and are lowered to a position slightly lower than a reference plane. The suction cups 118 are caused by the motor 114 to lift the bottom 12*c* of the gusseted package 12 into a substantially vertically intermediate position across the height of the gusseted package 12 as it is opened.

Figure 6:
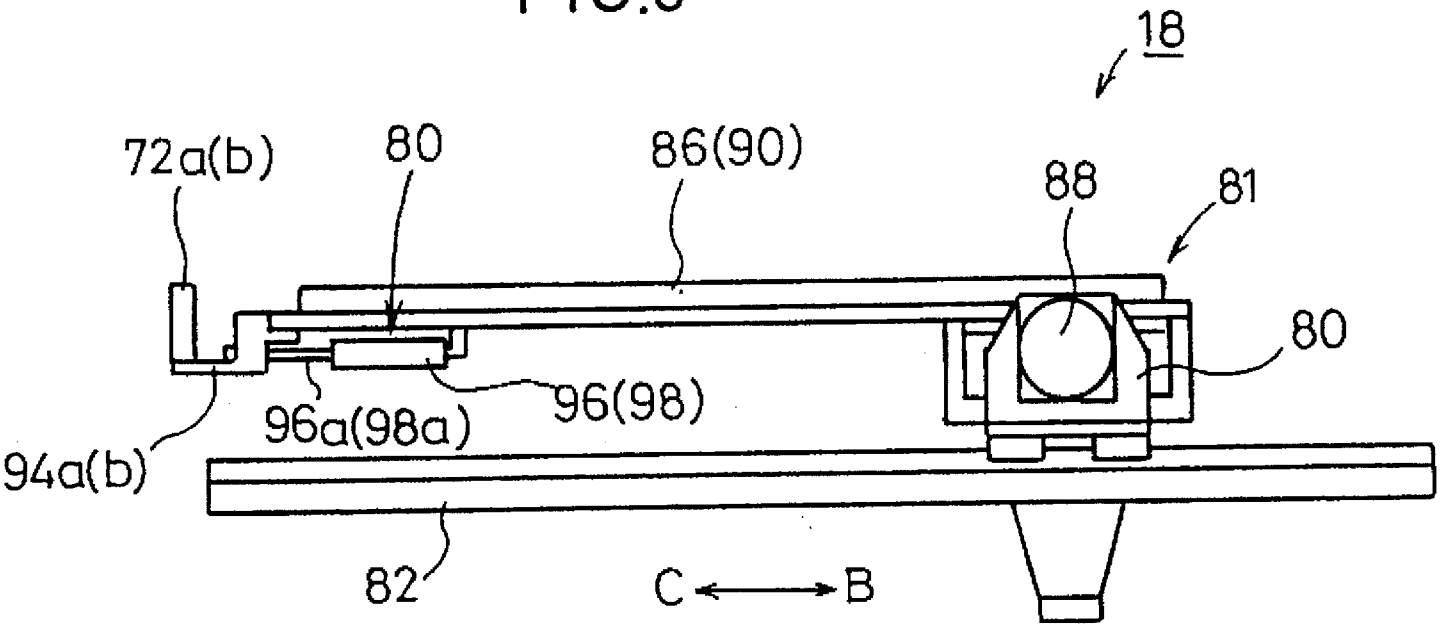
FIG. 6 is a side elevational view of the system for actuating the gusset rollers.

Then, as shown in FIGS. 5 and 6, the movable block 84 is moved toward the gusseted package 12 in the direction indicated by the arrow C by the cam mechanism 682, and the gusset rollers 72*a*, 72*b* which have been angularly moved inwardly toward each other are displaced into the gusseted package 12. After the gusset rollers 72*a*, 72*b* have been moved to a given position in the gusseted package 12, the cylinders 96, 98 of the opening and closing device 80 on the first and second support bars 86, 90 are actuated, angularly moving the gusset rollers 72*a*, 72*b* outwardly away from each other about the respective shafts 92*a*, 92*b*. The gusset rollers 72*a*, 72*b* now operate to spread outwardly the gussets 12*b* of the gusseted package 12 within the gusseted package 12.

When the gusset rollers 72*a*, 72*b* are angularly moved outwardly away from each other, the distance between them is slightly smaller than the width of the gusseted package 12. Therefore, when the gussets 12*b* are spread outwardly by the respective gusset rollers 72*a*, 72*b*, the gussets 12*b* are prevented from unduly projecting laterally out of the gusseted package 12.

In timed relation to the movement of the gusset rollers 72*a*, 72*b* into the gusseted package 12, the bottom forming device 76 is actuated. Specifically, as shown in FIG. 8, the horizontal pivot shaft 120 of the bottom forming device 76 is rotated about its own axis in the direction indicated by the arrow through the cam mechanism 682, causing the arm 124 and the connecting rod 126 to move the rods 130*a*, 130*b* in the direction indicated by the arrow B. The vertical forming plate 132 on the distal ends of the rods 130*a*, 130*b* is displaced toward the bottom 12*c* of the gusseted package 12. After the suction cups 118 have released the bottom 12*c* of the gusseted package 12 and been elevated, the vertical forming plate 132 contacts the bottom 12*c* of the gusseted package 12 at the time that the gusset rollers 72*a*, 72*b* contact the bottom 12*c* of the gusseted package 12.

Thereafter, the horizontal pivot shaft 120 is reversed through the cam mechanism 682, moving the vertical forming plate 132 away from the bottom 12*c* of the gusseted package 12. The gusset rollers 72*a*, 72*b* are angularly moved inwardly toward each other by the opening and closing device 80, and retracted in unison with the movable block 84 away from the gusseted package 12 while keeping the gusseted package 12 in shape. The upper suction cups 102*a*≠102*d* and the lower suction cups 100*a*≠100*d* are released from attracting the gusseted package 12, and the upper suction cups 102*a*≠102*d* are lifted a given distance by the cylinder 107 away from the gusseted package 12. The gusseted package 12 is now formed to a predetermined open shape as a whole from the open end 12*a* to the bottom 12*c*.

The gusseted package 12 as formed to a predetermined open shape by the opening mechanism 18 is delivered in the direction indicated by the arrow A by the conveyor 16, while the open end 12*a* thereof is being attracted by the lower and upper suction belts 60, 62, and is positioned in the inserting mechanism 22.

In the inserting mechanism 22, as shown in FIG. 11, the cams 156*a*, 156*b* are actuated through the cam mechanism 682, turning the vertical pivot shafts 146*a*, 146*b* in unison with the rotatable members 152*a*, 152*b* through more than 90°, in this embodiment, about 100°. Therefore, the upper and lower guide members 143*a*, 145*a* and the upper and lower guide members 143*b*, 145*b* enter the gusseted package 12, engage inner surfaces of the gussets 12*b* thereof, and remain in engagement with the gussets 12*b* under the bias of springs (not shown) regardless of the angular movement of the vertical pivot shafts 146*a*, 146*b* (see FIG. 10).

Since the gussets 12*b* are now kept straight without sagging, the side guide plates 172*a*, 172*b* are prevented from piercing the gusseted package 12 when a product 20 is inserted into the gusseted package 12, as described later on. The cam mechanism 682 actuates the swing cam 166, turning the package presser plates 168 with the turn shaft 164 to press and hold the lower surface of the open end 12*a* of the gusseted package 12 within the gusseted package 12.

A product 20 which is placed in the product stock 210 shown in FIG. 1 is positioned and delivered onto the insertion conveyor 144. As shown in FIG. 9, the motor 212 is de-energized, and then the cam rod 222 is lifted through the cam mechanism 682. The horizontal joint plate 220 fixed tot he cam rod 222 and the sliders 217*a*, 217*b* are elevated, lifting the endless belt 216. The product 20 on the endless belt 216 is not placed in a position corresponding to the pushing device 142.

At this time, the cylinders 200*a*, 200*b* are actuated to cause the rods 202*a*, 202*b* to swing the swing bars 204*a*, 204*b*, opening the side guide plates 172*a*, 172*b* away from each other. Therefore, when the product 20 is lifted, the product 20 is prevented from interfering with the side guide plates 172*a*, 172*b*. After the insertion conveyor 144 is elevated, the cylinders 200*a*, 200*b* are actuated to turn the side guide plates 172*a*, 172*b* inwardly toward each other (see FIG. 12).

In synchronism with operation of the endless belt 216 actuated by the motor 212, the cam rod 190 is pulled in the direction indicated by the arrow C (FIG. 9) through the cam mechanism 682. The attachment plates 198*a*, 198*b* of the pushing device 142 move toward the gusset package 12 along the movable guide member 174*a* and the fixed guide member 174*b*. The speed of movement by the pushing device 142 is slightly greater than the speed at which the product 20 is fed by the insertion conveyor 144. The rollers 170*a*, 170*b* on the attachment plates 198*a*, 198*b* press the product 20 on the insertion conveyor 144 while centering the product 20, and insert the product 20 into the gusseted package 12 (see FIG. 10).

Before the pushing device 142 arrives at the end of its forward stroke, the product bearing plate 141 has been moved to a position corresponding to the bottom 12*c* of the gusseted package 12 through the cam mechanism 682.

The product 20 is kept out of contact with the gusseted package 12 by the side guide plates 172*a*, 172*b* that are positioned one on each side of the product 20. Since the product 20 is pushed and centered by the rollers 170*a*, 170*b*, the product 20 is reliably prevented from contacting the side guide plates 172*a*, 172*b*. Therefore, the product 20 can reliably be inserted into the gusseted package 12 and at the same time is effectively prevented from being contacted and damaged by the side guide plates 172*a*, 172*b* and the gusseted package 12. The tapered edges 208*a*, 208*b* on the distal ends of the side guide plates 172*a*, 172*b* prevent the side guide plates 172*a*, 172*b* from piercing the gussets 12*b* of the gusseted package 12.

After the product 20 has been inserted in the gusseted package 12, the pushing device 142 is retracted through the cam mechanism 682, moving the rollers 170*a*, 170*b* and the side guide plates 172*a*, 172*b* away from the gusseted package 12 and also moving the product bearing plate 141 away from the bottom 12*c* of the gusseted package 12. The vertical pivot shafts 146*a*, 146*b* of the corner guide device 140 are turned, angularly moving the upper guide member 143*a* and the lower guide member 145*a*, and the upper guide member 143*b* and the lower guide member 145*b* inwardly away from the gussets 12*b* of the gusseted package 12. The package presser plates 168 are swung upwardly by the turn shaft 164 away from the lower surface of the open end 12*a* of the gusseted package 12.

The gusseted package 12 with the product 20 inserted therein is delivered to a position corresponding to the open end forming mechanism 24 by the conveyor 16. In the open end forming mechanism 24, as shown in FIGS. 16 and 17, the cam rod 250 is pulled in the direction indicated by the arrow C through the cam mechanism 682, moving the first and second moving bases 246*a*, 246*b* along the respective first and second movable rails 244*a*, 244*b* in the direction indicated by the arrow C. The first and second forming arms 230*a*, 230*b* as they are open as indicated by the two-dot-and-dash lines in FIG. 16 are moved toward the gusseted package 12 until they reach a given position with respect to the gusseted package 12.

The first and second cylinders 252*a*, 252*b* of the actuator device 234 are actuated to project their rods 254*a*, 254*b* in the direction indicated by the arrow C, angularly moving the first and second forming arms 230*a*, 230*b* toward each other. The first and second forming arms 230*a*, 230*b* now fold the respective gussets 12*b* inwardly into the gusseted package 12.

The closing device 232 is then actuated. Specifically, as shown in FIGS. 18 and 19, the upper sliders 262 are actuated through the cam mechanism 682 to lower the plate 266 and the first upper grip plate 256*a* to a predetermined position, and the lower sliders 270 are actuated to elevate the plate 273 and the first lower grip plate 258*a* to a predetermined position. The first upper grip plate 256*a* and the first lower grip plate 258*a* are positioned such that they are spaced from each other by a distance greater than the thickness of the first and second forming arms 230*a*, 230*b* which have folded inwardly the gussets 12*b* of the gusseted package 12, and grip therebetween the open end 12*a* of the gusseted package 12.

The first and second forming arms 230*a*, 230*b* are displaced away from each other by the first and second cylinders 252*a*, 252*b* and retracted in the direction indicated by the arrow B. At the same time, the upper and lower sliders 262, 270 are actuated to fully close the first upper grip plate 256*a* and the first lower grip plate 258*a* against each other, holding flatwise the open end 12*a* of the gusseted package 12.

Then, the upper and lower sliders 264, 272 are actuated to move the second upper grip plate 256*b* and the second lower grip plate 258*b* toward each other, gripping the open end 12*a* of the gusseted package 12 at a position inward of the position in which the first upper grip plate 256*a* and the first lower grip plate 258*a* grip the open end 12*a* of the gusseted package 12. Thereafter, as shown in FIG. 20, the third upper grip plate 256*c* is lowered by the cylinder 230, and the rods 288 are elevated by the cam roller 292 which engages the cam mechanism 682, lifting the third lower grip plate 258*c*. The third upper and lower grip plates 256*c*, 258*c* grip the open end 12*a* of the gusseted package 12 at an inward position.

With the open end 12*a* of the gusseted package 12 being gripped by the first upper grip plate 256*a* and the first lower grip plate 258*a*, the open end 12*a* of the gusseted package 12 is also successively gripped by the second upper and lower grip plates 256*b*, 258*b* and the third upper and lower grip plates 256*c*, 258*c*. At this time, the gusseted package 12 produces resistive forces tending to resist being gripped by these grip plates.

However, the first upper grip plate 256*a* and the first lower grip plate 258*a* are movable with respect to the plates 266, 273 through the guide rails 268, 274. Therefore, the first upper grip plate 256*a* and the first lower grip plate 258*a* can freely move in the direction indicated by the arrow C, preventing the gusseted package 12 from producing resistive forces. The second and third upper grip plates 256*b*, 256*c* and the second and third lower grip plates 258*b*, 258*c* have the rollers 267, 283, 275, 295 for rolling contact with the gusseted package 12 to prevent the gusseted package 12 from producing resistive forces.

Thus, when the open end 12*a* of the gusseted package 12 is closed by the closing device 232, the open end 12*a* is not wrinkled, and the product 20 in the gusseted package 12 is prevented from being damaged.

When the third upper and lower grip plates 256*c*, 258*c* are displaced toward each other, as shown in FIG. 20, they grip the open end 12*a* of the gusseted package 12 with the engaging pin 298 fitted in the hole 296. The upper sliders 262, 264 and the lower sliders 270, 272 are actuated, lifting the first and second upper grip plates 256*a*, 256*b* and lowering the first and second lower grip plates 258*a*, 258*b*. Thereafter, the cam rod 294 is pulled in the direction indicated by the arrow A through the cam mechanism 682 in synchronism with the conveyor 16.

The third lower grip plate 258*c* supported on the lower moving base 286 moves in the direction indicated by the arrow A in unison with the third upper grip plate 256*c* while the third upper and lower grip plates 256*c*, 258*c* are gripping the open end 12*a* of the gusseted package 12 with the engaging pin 298 fitted in the hole 296, thereby delivering the gusseted package 12 into the first folding station 300 of the folding mechanism 28.

When the gusseted package 12 is delivered into the first folding station 300, the third lower grip plate 258*c* is lowered through the cam mechanism 682, and the third upper grip plate 256*c* is elevated by the cylinder 280. The third lower grip plate 258*c* is moved by the cam rod 294 in the direction opposite to the direction indicated by the arrow A back to the position corresponding to the open end forming mechanism 24. The third upper grip plate 256*c* is moved back to the position corresponding to the open end forming mechanism 24 by a cylinder or the like which engages the upper moving base 278.

In the first folding station 300, as shown in FIGS. 21 and 22, the first and second cams 310, 314 of the folding device 308 are angularly moved through the cam mechanism 682 to lower the movable folding plate 320 at a position spaced a given distance from the fixed folding plate 322 for thereby folding the horizontal flat open end 12*a* of the gusseted package 12 vertically downwardly through 90°.

Figure 32:
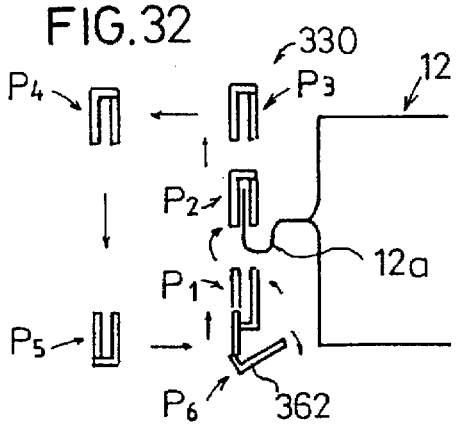
FIG. 32 is a view showing the manner in which first folding plates in the first folding station operate.

The first folding plates 362 of the first folder 330 are operated as shown in FIG. 32 for effecting a first folding process to fold the open end 12*a* of the gusseted package 12, which has been folded vertically downwardly, back upwardly through about 180°.

Specifically, the first swing cam 342 is actuated through the cam mechanism 682, causing the roller 344 on the first swing cam 342 and the vertical guide 340 to move the slide 338 along the guide rail 336 on the vertically movable plate 334 in the direction indicated by the arrow C (see FIGS. 21 and 23). Before the first folding plates 362 reach a position P1 (FIG. 32), i.e., are in a position P6, the presser plate 366 has been actuated by the cylinder 364 forcibly opening the first folding plates 362. In the position P1, the cylinder 364 is deactivated to close the first folding plates 362, causing their distal ends to grip the tip end of the open end 12*a* of the gusseted package 12.

Then, the second swing cam 346 is actuated through the cam mechanism 682, moving the slider 350 in the direction indicated by the arrow B through the roller 348 and the guide 352. The pinion 356 meshing with the rack 354 which is mounted on the slider 350 is now rotated. The rotation of the pinion 356 is transmitted through the belt and pulley mechanisms 360 coupled to the rotatable shaft 358 to the first folding plates 362, which are then turned upwardly through 180° into a position P2 shown in FIG. 32.

The open end 12*a* gripped by the first folding plates 362 are now folded upwardly through 180° from the vertically downward direction. As shown in FIGS. 26 and 27, the attachment base 520 is lifted through the cam 518 of the first feed chuck 500, whereupon the first chucks 524 grip, from below, the open end 12*a* which has been folded upwardly through 180°.

As shown in FIGS. 21 and 22, the sliders 332 are actuated through the cam mechanism 682 to lift the vertically movable plate 334. When the first folding plates 362 reach a position P3, the slide 338 moves in the direction indicated by the arrow B in response to angular movement of the first swing cam 342, displacing the first folding plates 362 to a position P4. The vertically movable plate 334 is lowered by the sliders 332, displacing the first folding plates 362 to a position P5, after which the first and second swing cams 342, 346 are actuated to position the first folding plates 362 in an upward orientation in the position P6.

The first feed chuck 500 which has gripped the open end 12*a* of the gusseted package 12 is moved in the direction indicated by the arrow A in synchronism with the conveyor 16 through the cam mechanism 682, delivering the gusseted package 12 from the first folding station 300 to the second folding station 302. In the second folding station 302, as shown in FIG. 33, the second folding plates 402 of the second folder 370 move from a position P1a to a position P6a, effecting a second folding process to fold back the open end 12*a* further through 180° after the first folding process.

Operation of the second folder 370 in the second folding process is essentially the same as the first folder 333, and will briefly be described below with reference to FIG. 24. First, the slide 378 is moved in the direction indicated by the arrow C by the first swing cam 384, and then lifted by the sliders 372, placing the second folding plates 402 in the position P1a in FIG. 33. After the second folding plates 402 grip the first folded portion of the open end 12*a*, the first chucks 524 of the first feed chuck 500 are lowered by the attachment base 520 away from the open end 12*a*. The first feed chuck 500 as it is lowered in the second folding station 302 is moved in the direction opposite to the direction indicated by the arrow A through the cam mechanism 682, and placed in the first folding station 300.

After the second folding plates 402 have gripped the open end 12*a* (first folded portion) of the gusseted package 12, as shown in FIG. 24, the rotatable shaft 398 is rotated about its own axis by the second swing cam 388 through the rack 394 and the pinion 396, causing the belt and pulley mechanisms 400 to turn the second folding plates 402 upwardly through about 180°. The open end 12*a* of the gusseted package 12 is now folded back upwardly further through 180° in the second folding process. The second folding plates 402 are displaced successively through positions P2a≠P6a back to the position P1a by the sliders 372 and the first and second swing cams 384, 388, in readiness for folding a next gusseted package 12 in the second folding process.

Figure 33:
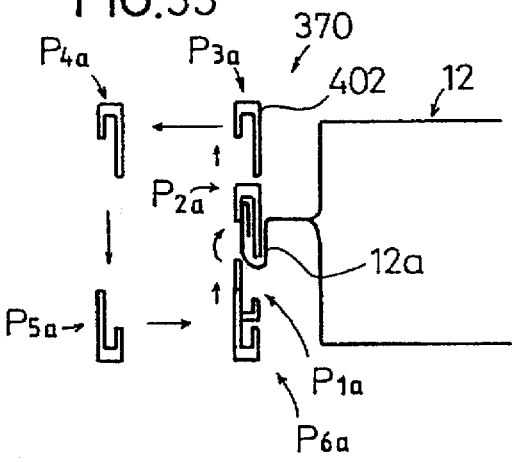
FIG. 33 is a view showing the manner in which second folding plates in the second folding station operate.

When the open end 12*a* is folded in the second folding process at the position P2a in FIG. 33, the second feed chuck 502 is lifted to grip the second folded portion of the open end 12*a*, as shown in FIG. 26. After the second folding plates 402 have been released from the second folded portion of the open end 12*a* (see the position P3a), the second feed chuck 502 moves to the third folding station 304 in synchronism with the conveyor 16.

Figure 34:
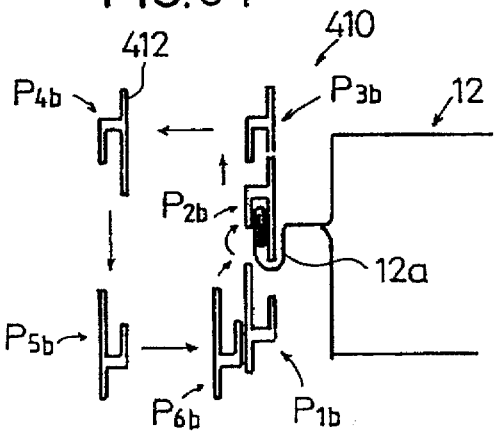
FIG. 34 is a view showing the manner in which third folding plates in the third folding station operate.

In the third folding station 304, the third folding plates 412 of the third folder 410 move from a position P1b to a position P6b shown in FIG. 34, folding the open end 12*a*, which has been folded twice, in a third folding process. Since the third folder 410 operates in the same manner as the second folder 370, its operation will not be described in detail below.

When the third folding plates 412 reach the position P2b, folding the open end 12*a* of the gusseted package 12 in the third folding process, the third feed chuck 504 shown in FIGS. 26 and 28 is actuated. Specifically, the cylinder 532 is actuated to turn the swing arms 534 about the pivot shaft 536, causing the presser plate 538 to press and hold the open end 12*a* (third folded portion) of the gusseted package 12. The first feed chuck 500, the second feed chuck 502, and the third feed chuck 504 are now moved along the guide rail 510 in the direction indicated by the arrow A in synchronism with the conveyor 16, until the third feed chuck 504 reaches a position corresponding to the sealing mechanism 30.

In the folding mechanism 28, as described above, the open end 12*a* of the gusseted package 12 is folded vertically downwardly by the folding device 308 in the first folding station 300. Thereafter, the open end 12*a* is folded upwardly through about 180° by the first folder 330 in the first folding station 300. Then, in the second folding station 302, the open end 12*a* is folded upwardly through 180° by the second folder 370. In the third folding station 304, the open end 12*a* is folded upwardly through 180° by the third folder 410. As a consequence, the open end 12*a* is folded three times.

Inasmuch as the open end 12*a* of the gusseted package 12 is folded upwardly 180° in each of the folding processes, the first through third folding plates 362, 402, 412 are movable upwardly after the respective folding processes. Therefore, the first through third feed chucks 500, 502, 504 for holding and feeding the folded open end 12*a* in the direction indicated by the arrow A are reliably prevented from interfering with the first through third folding plates 362, 402, 412. Consequently, it is not necessary to increase the folded length of the open end 12*a* in a manner to cover a space which would otherwise be required to retract the first through third folding plates 362, 402, 412 therein, and it is also possible to prevent the open end 12*a* from being folded in error.

The gusseted package 12 with the open end 12*a* folded three times, i.e., with the folded end 26, held by the third feed chuck 504, is fed from the second folding station 302 to the position corresponding to the sealing mechanism 30. Thereafter, the pressers 628 project to press and hold the folded end 26, and the cylinder 532 of the third feed chuck 504 is operated to displace the presser plate 538 away from the folded end 26. The third feed chuck 504 is lowered earlier than the first and second feed chucks 500, 502, and moves in unison therewith in the direction opposite to the direction indicated by the arrow A into a position corresponding to the third folding station 304.

In the sealing mechanism 30, the vertically movable bases 654*a*, 654*b* of the tape drawing device 616 are lifted along the guide rails 652*a*, 652*b* by the belt and pulley mechanism 653. The cylinders 656*a*, 656*b* are operated to turn the swing plates 658*a*, 658*b*, causing the chuck rollers 660*a*, 660*b* and the chuck plates 662*a*, 662*b* to grip the leading end of the adhesive tape 614.

Figure 35:
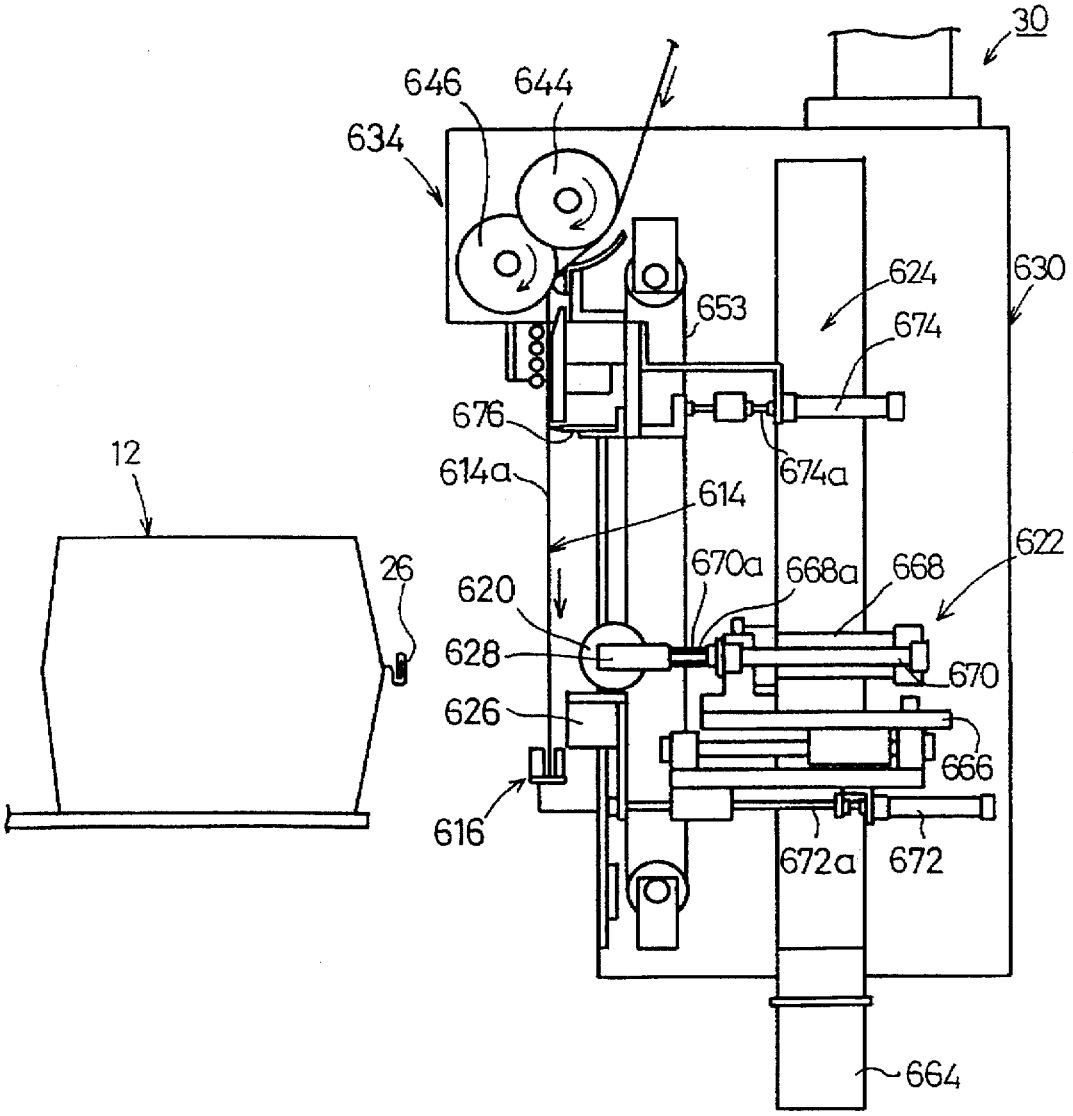
FIG. 35 is a side elevational view of the sealing mechanism, showing the manner in which an adhesive tape is withdrawn.

Then, as shown in FIG. 35, the gusseted package 12 is placed in a tape bonding position, and the tape unreeling device 634 and the tape drawing device 616 are actuated in synchronism with each other. Specifically, the motor 636 of the tape unreeling device 634 is energized to cause the gear train 638 to rotate the first and second rotatable shafts 640, 642 in one direction as indicated by the arrows in FIG. 35. The knurled surfaces 644*a* of the feed rollers 644 engage the adhesive surface 614*a* of the adhesive tape 614, forcibly unreeling the adhesive tape 614 from the tape reel 612. The vertically movable bases 654*a*, 654*b* are lowered by the belt and pulley mechanism 653, withdrawing downwardly the adhesive tape 614 which is being gripped by the chuck rollers 660*a*, 660*b* and the chuck plates 662*a*, 662*b*.

Figure 36:
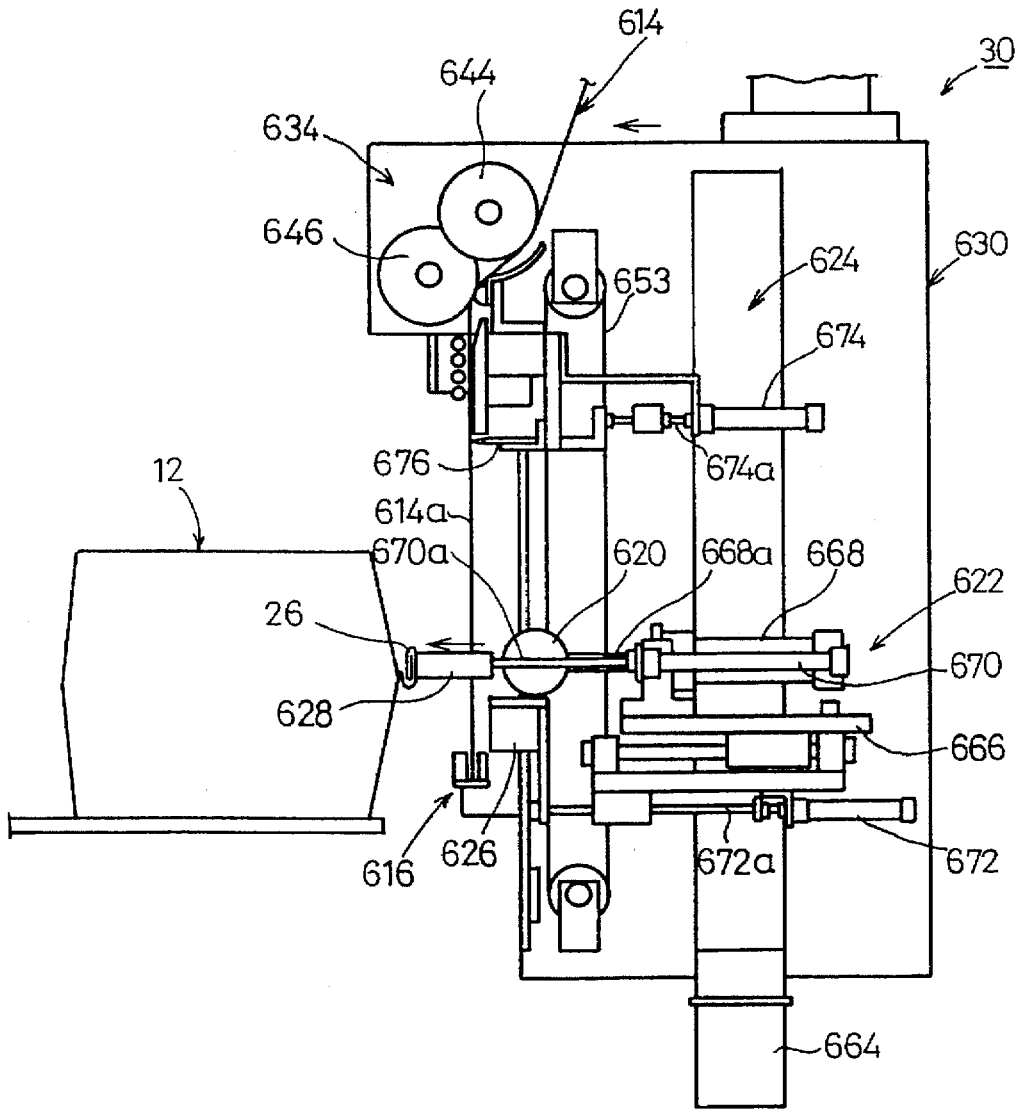
FIG. 36 is a side elevational view of the sealing mechanism, showing the manner in which pressers are advanced.

When the withdrawal of the adhesive tape 614 is finished, as shown in FIG. 36, the frame 630 is advanced, i.e., moved toward, the gusseted package 12, and the second drive cylinders 670 are actuated to move the pressers 628 toward the gusseted package 12. The pressers 628 now press and support the folded end 26 of the gusseted package 12.

The first drive cylinder 668 of the moving device 622 is operated to project the rod 668*a*, enabling the bonding roller 620 to press the adhesive surface 614*a* of the adhesive tape 614 against the gusseted package 12. Therefore, the portion of the adhesive tape 614 which extends upwardly a certain distance from the leading end gripped by the tape drawing device 616 is bonded to the gusseted package 12.

Figure 37:
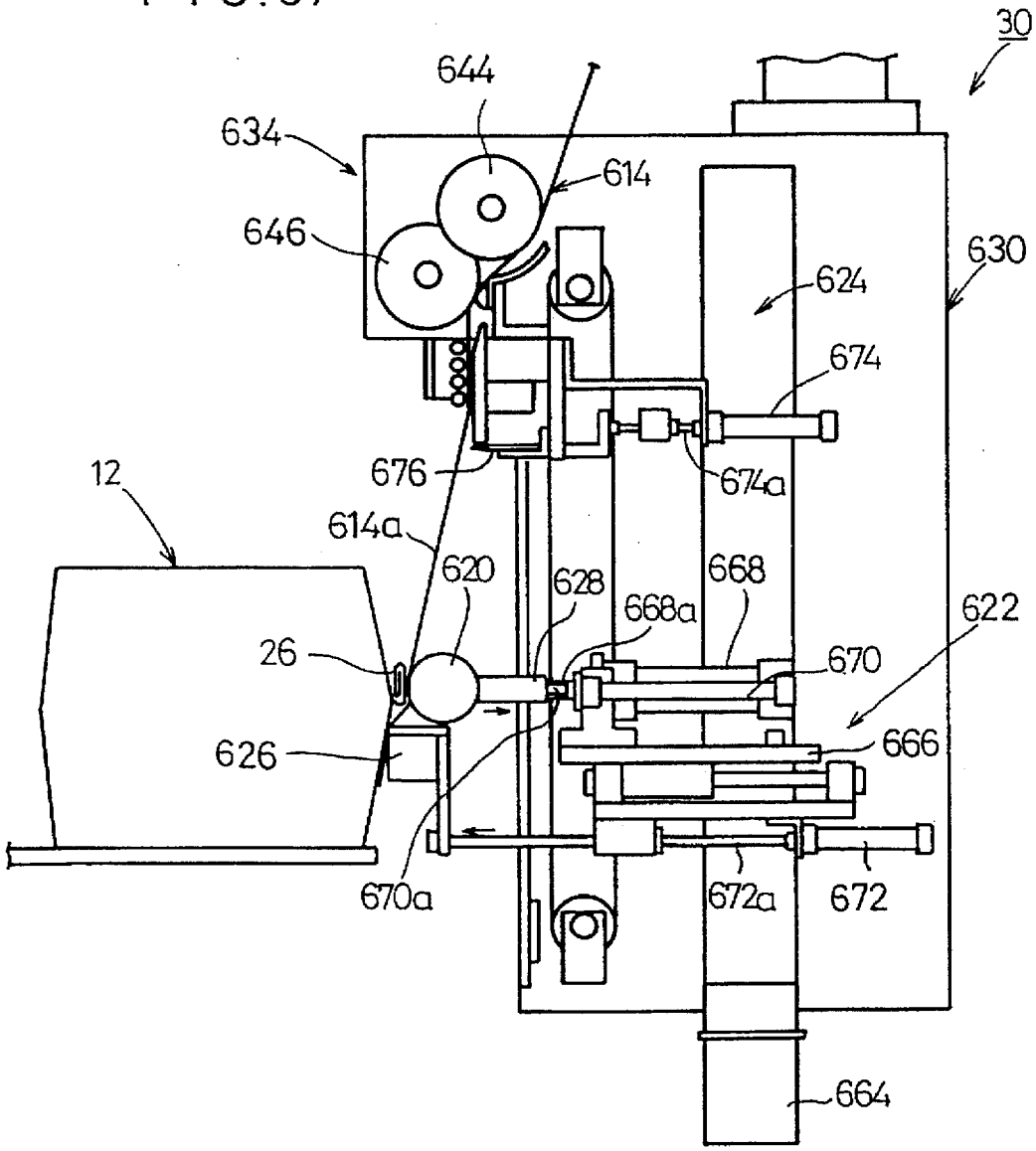
FIG. 37 is a side elevational view of the sealing mechanism, showing the manner in which a bonding roller and a bonding member are advanced.

The third drive cylinder 672 is operated to move the bonding member 626 fixed to the rod 672*a* toward the gusseted package 12, bonding the leading end of the adhesive tape 614 to the gusseted package 12 (see FIG. 37). At this time, the chuck rollers 660*a*, 660*b* have been angularly moved out of gripping engagement with the adhesive tape 614 by the cylinders 656*a*, 656*b*.

Figure 38:
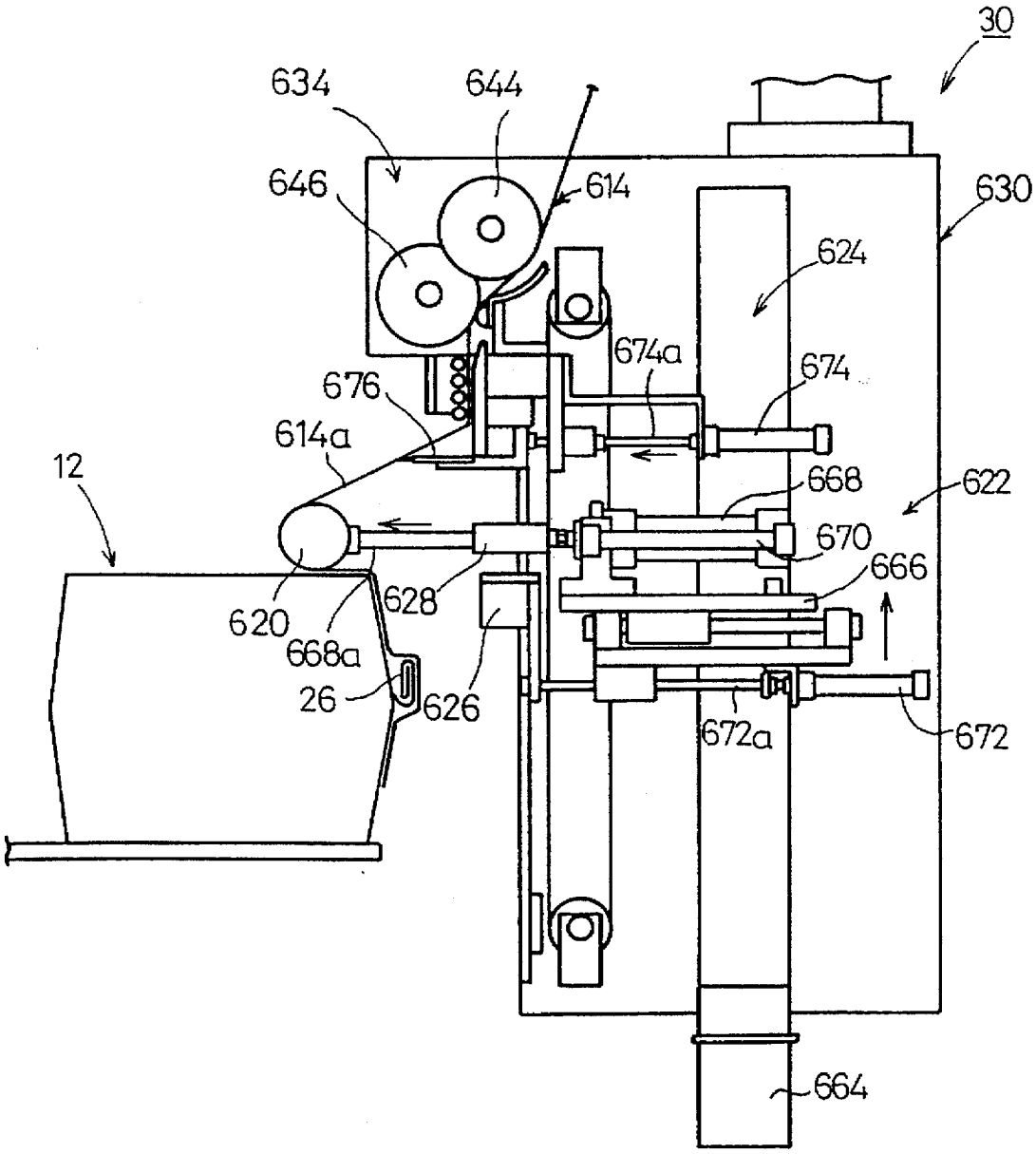
FIG. 38 is a side elevational view of the sealing mechanism, showing the manner in which the bonding roller is further advanced.
Figure 39:
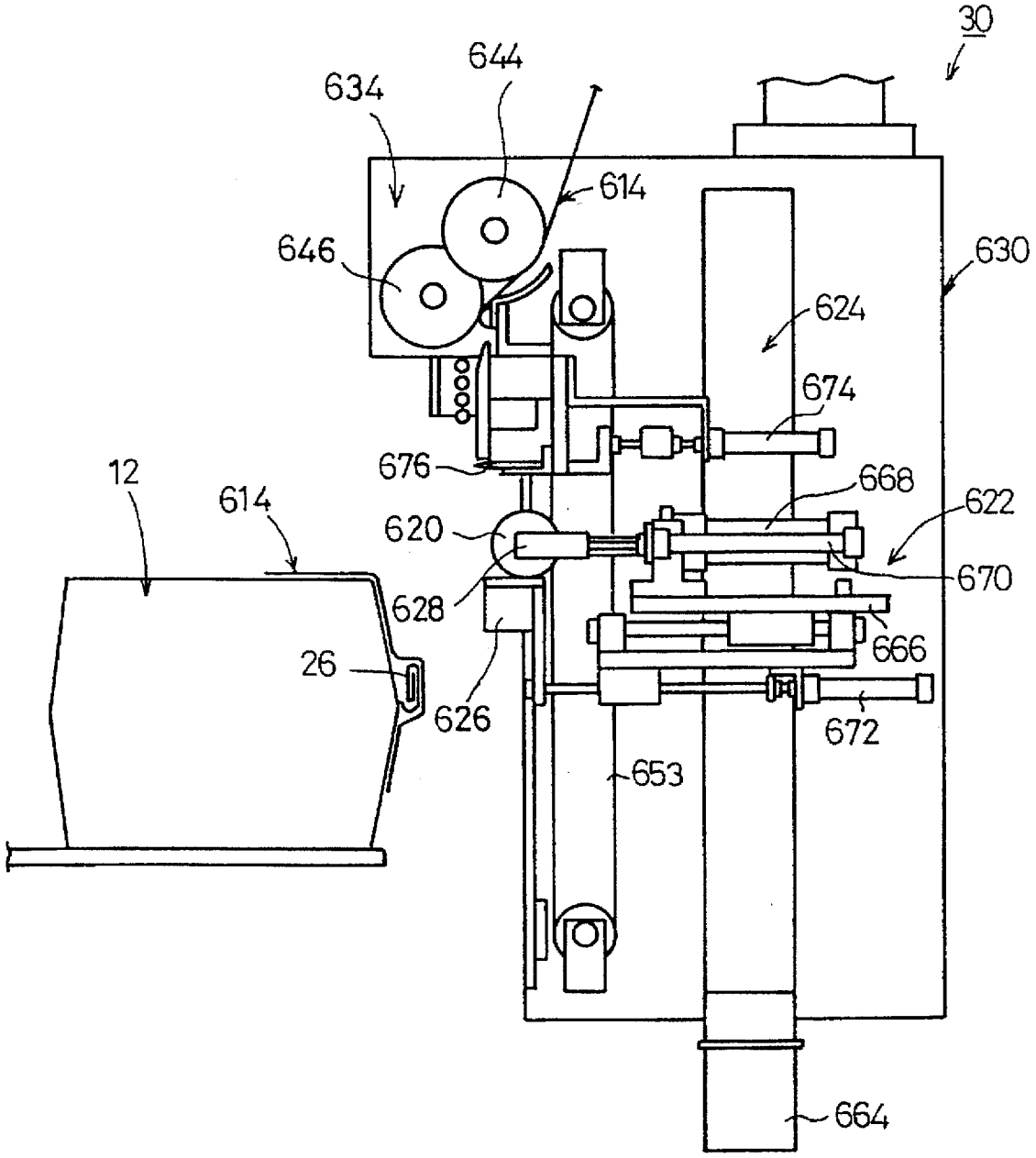
FIG. 39 is a side elevational view of the sealing mechanism, showing the manner in which the application of the adhesive tape by the bonding roller is finished.

After having applied the leading end of the adhesive tape 614 to the gusseted package 12, the bonding member 626 is retracted by the third drive cylinder 672, and the servomotor 664 of the moving device 622 is energized to elevate the bonding roller 620 with the vertically movable base 666 up to a desired height while bonding the adhesive tape 614 to the gusseted package 12. Upon completion of the ascent of the bonding roller 620, the fourth drive cylinder 674 of the cutter device 624 is actuated to advance the cutter 676 to cut off the adhesive tape 614 to a certain length (see FIG. 38).

Figure 40:
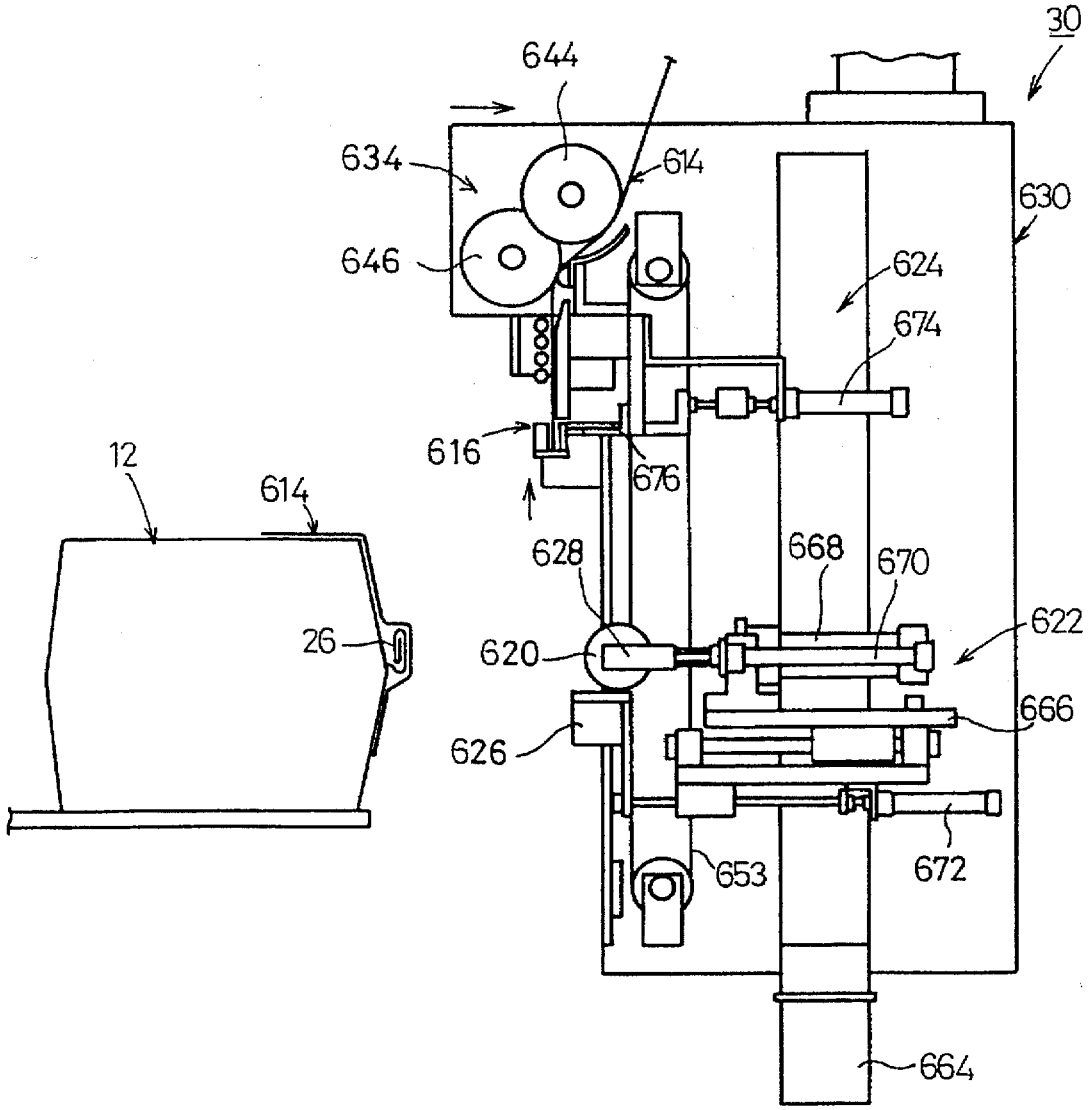
FIG. 40 is a side elevational view of the sealing mechanism, showing the manner in which the various components thereof are held in a standby position.

After the adhesive tape 614 is cut off, the four drive cylinder 674 is operated to retract the cutter 686, and the bonding roller 620 is advanced by the first drive cylinder 668 to apply the cut-off adhesive tape 614 to the upper surface of the gusseted package 12. Then, the bonding roller 620 is retracted by the first drive cylinder 668 (see FIG. 38), after which the vertically movable bases 654*a*, 654*b* are lifted to the upper end of their upward stroke. The bonding roller 620 is lowered to its initial position, and the frame 630 is retracted (see FIG. 40).

After the gusseted package 12 has been sealed, the gusseted package 12 is delivered to a next process by the conveyor 16.

In this embodiment, the sealing mechanism 30 has the tape drawing device 616 for gripping the leading end of the adhesive tape 614 and drawing a predetermined length of the adhesive tape 614, the moving device 622 for pressing the bonding roller 620 against the adhesive tape 614, and the cutter device 624 for cutting off the adhesive tape 614 to a desired length. The process of withdrawing the adhesive tape 614 wound on the tape reel 612 by a desired length, bonding the adhesive tape 614 to the gusseted package 12, and cutting off the adhesive tape 614 to a desired length can automatically be carried out, and hence the entire process of bonding the adhesive tape 614 can easily be automatized.

The bonding roller 620 is movable in two directions, i.e., in the horizontal direction indicated by the arrow X and the vertical direction indicated by the arrow Y. Therefore, the bonding roller 620 can apply the adhesive tape 614 continuously to vertical and horizontal surfaces of the gusseted package 12. The adhesive tape 614 can thus be applied easily and reliably to any of various workpieces having different shapes such as box and cylindrical shapes. Consequently, the sealing mechanism 30 is highly versatile in applications. Alternatively, the bonding roller 620 may be movable in three directions.

The bonding roller 620 may be moved to any of various different heights by changing settings for the servomotor 664. Therefore, the bonding roller 620 can effectively be used when the height (thickness) of the gusseted package 12 is varied.

In this embodiment, the opening mechanism 18 is positioned to carry out an opening process prior to a inserting process carried out by the inserting mechanism 22. The opening mechanism 18 serves to form the gusseted package 12 forcibly to an open shape. Therefore, the gusseted package 12 which is delivered to the inserting mechanism 22 has already been forcibly opened in the shape of a rectangular parallelepiped. When the product 20 is inserted into the gusseted package 12, the gusseted package 12 is reliably prevented from being wrinkled because the gusseted package 12 has already been opened and the product 20 can be inserted without undue interference with the gusseted package 12.

The open end forming mechanism 24 which follows the inserting mechanism 22 folds in the gussets **12*b* and flattens the open end 12*a*. When the open end forming mechanism 24 thus operates, the open end 12*a* is prevented from being wrinkled. When the open end 12*a* is folded by the first through third folding stations 300, 302, 304 of the folding mechanism 28, the open end 12*a* is prevented from being wrinkled and also from a folding failure or error which would otherwise be caused by wrinkles in the open end 12*a*. Because the gusseted package 12 is not forcibly opened by the product 20 itself, the product 20 is protected from damage. The product 20** can thus be efficiently and accurately packaged and sealed.

Furthermore, the opening mechanism 18, the inserting mechanism 22, the open end forming mechanism 24, the folding mechanism 28, and the sealing mechanism 30 can be operated in unison with each other through the cam mechanism 682 in synchronism with the conveyor 16. This allows the entire packaging process to be effected at high speed.

Usually, various products having different sizes or dimensions are packaged as the product 20. The packaging and sealing apparatus 10 need various adjustments to be made when dimensions of the product 20 and the gusseted package 12 for packaging the product 20 are varied.

Specifically, in the opening mechanism 18, as shown in FIG. 5, the motor 88 of the distance adjusting device 81 is energized to rotate the ball screw 89 to move the second support bar 90 in the direction indicated by the arrow A. The distance between the gusset rollers **72*a*, 72*b* is now adjusted depending on the width of a new gusseted package 12** to be used.

Depending on the height of a new gusseted package 12 to be used, the vertically movable frame 106 which supports the upper suction cups **102*a*≠102*d* is varied in its vertical position, and the suction cups 118 of the bottom suction device 74** are varied in their vertical position.

In the inserting mechanism 22, the horizontal moving device 147 and the vertical moving device 149 of the corner guide device 140 are actuated depending on the width and height of a new gusseted package 12 to be used (see FIG. 11). When the motor 160 of the horizontal moving device 147 is energized to rotate the ball screw 162, the movable frame 158 is moved horizontally to adjust the distance between the upper and lower guide members **143*a*, 145*a* and the upper and lower guide members 143*b*, 145*b*. When the sliders 150*a*, 150*b* of the vertical moving device 149 are vertically moved, the distance between the upper guide members 143*a*, 143*b* and the lower guide members 145*a*, 145*b***.

In the inserting mechanism 22, the distance adjusting device 176 of the pushing device 142 is actuated (see FIGS. 13 and 14). When the motor 178 of the distance adjusting device 176 is energized to rotate the ball screw 182 through the belt and pulley mechanism 180, the movable guide member **174*a* moves horizontally in unison with the slide base 186*a*. As shown in FIG. 12, the distance between the rollers 170*a*, 170*b* and the distance between the side guide plates 172*a*, 172*b* are adjusted depending on dimensions of a new product 20 to be used. The upper suction belt 62 shown in FIG. 10 is vertically moved depending on the height of the gusseted package 12** which has been varied.

Then, the height adjustment for the open end forming mechanism 24 and the folding mechanism 28 is carried out. Specifically, as shown in FIG. 3, when the motor 38 of the lifting and lowering mechanism 36 is energized to rotate the ball screw 40, the movable block 32 is vertically moved with respect to the fixed block 34 while being guided by the guide rails **43*a*. The open end forming mechanism 24 and the folding mechanism 28 which are mounted on the movable block 32, specifically, the first and second forming arms 230*a*, 230*b*, the closing device 232, the folding device 308, the first folders 330, 370, 410, and the feeder device 306**, are adjusted in height altogether.

In the sealing mechanism 30, the vertical position of the pressers 628 and the roller 620 is adjusted in height depending on the position of the folded end 26 of a new gusseted package 12 to be used.

Therefore, the packaging and sealing apparatus 10 can easily accommodate changes in the dimensions of the product 20 and the gusseted package 12 for packaging the product 20, and hence is highly versatile.

Inasmuch as the open end forming mechanism 24 and the folding mechanism 28 are mounted on the movable block 32, the open end forming mechanism 24 and the folding mechanism 28 can be adjusted in height simply when the movable block 32 is vertically moved with respect to the fixed block 34 through the lifting and lowering mechanism 36. Even though the folding mechanism 28 has the plural, e.g., three, folders 330, 370, 410 for folding the open end **12*a* of the gusseted package 12 a plurality of times, e.g., three times, it is not necessary to adjust the first through third folders 330, 370, 410** individually.

Accordingly, the procedure for adjusting the open end forming mechanism 24 and the folding mechanism 28, which has heretofore been considerably complex and time-consuming due to individual adjustments required, can easily be carried out in a short period of time, thereby simplifying a preparatory process for changes in the dimensions of the product 20 and the gusseted package 12. Therefore, the process of packaging products 20 of various dimensions can be carried out efficiently.

The packaging and sealing apparatus according to the present invention offers the following advantages:

Since a package is formed to an open configuration with its sides oriented perpendicularly before a product is inserted into the package, the package is not spread by the product when it is inserted into the package. Therefore, the package is reliably prevented from being wrinkled, and can stably be folded at its open end. The overall packaging process is made efficient. When the product is inserted into the package, the product is held out of frictional contact with the package, and hence is effectively prevented from being damaged.

The upper and lower suction belts prevent the package from being positionally displaced while the package is being conveyed. The corner guide device makes it possible to reliably spread the opening of the package in an elongate rectangular shape, thereby preventing an insertion failure upon insertion of the product.

When dimensions of the package and the product are varied, not only the movable block is vertically moved with respect to the conveyor, but also at least the open end forming mechanism and the folding mechanism are positionally adjusted altogether. Consequently, a preparatory process for changes in the dimensions of the package and the product is highly simplified, allowing products of various dimensions to be packaged efficiently.

The process of withdrawing an adhesive tape by a given length, thereafter bonding the adhesive tape to the package, and then cutting off the adhesive tape to a desired length is automatically carried out. Thus, the entire process of bonding the adhesive tape to the package can easily be automatized. Because the bonding roller is movable in at least two directions by the moving device, the adhesive tape can be applied easily and reliably to any of various workpieces having different shapes such as box and cylindrical shapes.

Although a certain preferred embodiment of the present invention has been shown and described in detail, it should be understood that various changes and modifications may be made therein without departing from the scope of the appended claims.

What is claimed is:

1. A packaging and sealing apparatus comprising:

a conveyor for conveying a package having an opening in an end thereof in a direction, with the opening being oriented transversely to said direction;

an opening mechanism for forming the package forcibly to an open configuration before a product is inserted into the package;

an inserting mechanism for inserting the product into the package which has been formed by said opening mechanism;

an open end forming mechanism for forming flatwise an open end of the package with the product inserted therein;

a folding mechanism for folding the flatwise formed open end into a folded end; and a sealing mechanism for fixing the folded end;

said opening mechanism, said inserting mechanism, said open end forming mechanism, said folding mechanism, and said sealing mechanism being successively arranged along said direction.

2. A packaging and sealing apparatus according to claim 1, wherein said opening mechanism comprises:

suction means for vertically drawing said package under suction to forcibly open said package; and gusset rollers for moving into said package and spreading apart gussets on opposite sides of the package.

3. A packaging and sealing apparatus according to claim 2, wherein said gusset rollers are paired depending on a width of the package, said opening mechanism having opening and closing means for displacing said gusset rollers within the package in a transverse direction of the package.

4. A packaging and sealing apparatus according to claim 3, wherein said opening and closing means comprises:

swing arms, said gusset rollers being rotatably mounted on ends of said swing arms for rotation about vertical axes, respectively; and cylinders engaging opposite ends of said swing arms.

5. A packaging and sealing apparatus according to claim 2, wherein said opening mechanism comprises bottom suction means for drawing under suction a bottom of the package opposite to the opening thereof, and holding the bottom in a substantially vertically intermediate position across the height of the package as it is opened.

6. A packaging and sealing apparatus according to claim 2, wherein said opening mechanism comprises bottom forming means for pressing and forming a bottom of the package opposite to the opening thereof when the package is opened.

7. A packaging and sealing apparatus according to claim 6, wherein said bottom forming means comprises:

rods movable toward the bottom of said package 12; and a vertical forming plate fixed to said rods.

8. A packaging and sealing apparatus according to claim 1, wherein said inserting mechanism comprises:

corner guide means for moving into said package as it is opened and engaging opposite sides of the package to keep the opposite sides of the package in shape; and pushing means for inserting the product into said package engaged by said corner guide means.

9. A packaging and sealing apparatus according to claim 8, wherein said corner guide means comprises:

upper guide members and lower guide members for engaging upper and lower portions of the opposite sides of the package; and pivot shafts for angularly moving horizontally said upper guide members and lower guide members into engagement with the upper and lower portions of the opposite sides of the package.

10. A packaging and sealing apparatus according to claim 8, wherein said pushing means comprises:

a pair of rollers for centering and pressing said product; and a pair of side guide plates disposed at the opposite sides of the package, respectively for preventing the product and said package out of contact with each other.

11. A packaging and sealing apparatus according to claim 10, wherein said side guide plates have respective tapered edges on distal ends thereof.

12. A packaging and sealing apparatus according to claim 1, wherein said open end forming mechanism comprises:

first and second forming arms disposed outwardly of the opposite sides of the package, respectively, and movable toward each other for folding inwardly gussets on opposite sides of the package; and closing means for closing the open end of the package with the gussets thereof being folded by said first and second forming arms.

13. A packaging and sealing apparatus according to claim 12, wherein said closing means comprises:

first upper and lower grip plates for vertically gripping the open end of said package, said first upper and lower grip plates being movable toward and away from said package;

second upper and lower grip plates for vertically gripping the open end of said package at a position inward of a position in which said first upper and lower grip plates vertically grip the open end of said package; and third upper and lower grip plates for vertically gripping the open end of said package at a position inward of the position in which said second upper and lower grip plates vertically grip the open end of said package, said third upper and lower grip plates being movable along said conveyor to a position corresponding to said folding mechanism while gripping said open end of the package.

14. A packaging and sealing apparatus according to claim 13, wherein said second upper and lower grip plates and said third upper and lower grip plates have rollers on respective upper and lower grip surfaces thereof which face each other.

15. A packaging and sealing apparatus according to claim 1, wherein said folding mechanism comprises:

a plurality of folding stations having respective folder means engaging upwardly the open end of the package and folding the open end upwardly through about 180°; and feeder means for gripping the folded open end of the package and feeding the package between said folding stations.

16. A packaging and sealing apparatus according to claim 15, wherein said feeder means comprises:

a plurality of feed chucks for gripping the open end which is folded in said folding stations; and joint bars joining said feed chucks for moving said feed chucks in unison with each other.

17. A packaging and sealing apparatus according to claim 15, wherein said first folding station has folding means for folding vertically downwardly the open end of the package which extends horizontally.

18. A packaging and sealing apparatus according to claim 17, wherein said folding means comprises:

a movable folding plate which is movable back and forth horizontally and vertically; and a fixed folding plate for folding vertically downwardly the open end of the package in coaction with said movable folding plate.

19. A packaging and sealing apparatus according to claim 1, further comprising:

a transfer device for positioning and transferring the package onto said conveyor;

a lower suction belt for attracting under suction a lower surface of the package from said transfer device to a position corresponding to said inserting mechanism; and an upper suction belt for attracting under suction an upper surface of the package from said transfer device to the position corresponding to said inserting mechanism.

20. A packaging and sealing apparatus according to claim 1, further comprising a cam mechanism for actuating said opening mechanism, said inserting mechanism, said open end forming mechanism, said folding mechanism, and said sealing mechanism in unison with each other in synchronism with said conveyor.

21. A packaging and sealing apparatus according to claim 1, wherein said sealing mechanism comprises:

tape drawing means for gripping a leading end of an adhesive tape and withdrawing the adhesive tape by a predetermined length;

a bonding roller for pressing an adhesive surface of the adhesive tape withdrawn by said tape drawing means against the folded end of said package;

moving means for moving said bonding roller in at least two directions crossing each other depending on a shape of said package; and cutter means movable toward and away from the adhesive tape for cutting off the adhesive tape at a given position thereon while the adhesive tape is being applied by said bonding roller.

22. A packaging and sealing apparatus according to claim 21, wherein said tape drawing means comprises:

movable bases movable back and forth by an actuator;

chuck rollers angularly movably mounted on said movable bases; and chuck plates fixed to said movable bases for gripping the leading end of said adhesive tape in coaction with said chuck rollers.

23. A packaging and sealing apparatus according to claim 21, further comprising a bonding member movable back and forth for bonding the leading end of the withdrawn adhesive tape to said package.

24. A packaging and sealing apparatus according to claim 21, further comprising pressers movable back and forth for supporting said package.

25. A packaging and sealing apparatus according to claim 21, further comprising:

tape unreeling means for unreeling said adhesive tape from a tape reel;

said tape unreeling means comprising rotatable feed rollers having knurled circumferential surfaces, respectively.

26. A packaging and sealing apparatus according to claim 25, wherein said feed rollers comprise a plurality of thin rollers of metal, said tape unreeling means further comprising a plurality of rotatable thin resin rollers axially alternating with and radially overlapping said thin rollers of metal.

27. A packaging and sealing apparatus comprising:

a conveyor for conveying a package having an opening in an end thereof in a direction, with the opening being oriented transversely to said direction;

an opening mechanism for forming the package forcibly to an open configuration before a product is inserted into the package;

an inserting mechanism for inserting the product into the package which has been formed by said opening mechanism;

an open end forming mechanism for forming flatwise an open end of the package with the product inserted therein;

a folding mechanism for folding the flatwise formed open end into a folded end; and a movable block for vertically moving said open end forming mechanism and said folding mechanism in unison with each other with respect to said conveyor depending on a change in dimensions of said package and said product.

28. A packaging and sealing apparatus according to claim 27, wherein said opening mechanism comprises:

suction means for vertically drawing said package under suction to forcibly open said package;

a pair of gusset rollers for moving into said package and spreading apart gussets on opposite sides of the package;

opening and closing means for displacing said gusset rollers within the package in a transverse direction of the package; and distance adjusting means for adjusting a distance between said gusset rollers depending on a change in width of said package.

29. A packaging and sealing apparatus according to claim 28, wherein said opening and closing means comprises:

swing arms, said gusset rollers being rotatably mounted on ends of said swing arms for rotation about vertical axes, respectively; and cylinders engaging opposite ends of said swing arms.

30. A packaging and sealing apparatus according to claim 28, wherein said opening mechanism comprises bottom suction means for drawing under suction a bottom of the package opposite to the opening thereof, and holding the bottom in a substantially vertically intermediate position across the height of the package as it is opened.

31. A packaging and sealing apparatus according to claim 28, wherein said opening mechanism comprises bottom forming means for pressing and forming a bottom of the package opposite to the opening thereof when the package is opened.

32. A packaging and sealing apparatus according to claim 28, wherein said bottom forming means comprises:

rods movable toward the bottom of said package; and a vertical forming plate fixed to said rods.

33. A packaging and sealing apparatus according to claim 27, wherein said inserting mechanism comprises:

corner guide means for moving into said package as it is opened and engaging opposite sides of the package to keep the opposite sides of the package in shape;

said corner guide means comprising:

rotatable first and second pivot shafts extending perpendicularly parallel to each other;

upper guide members and lower guide members mounted on said first and second pivot shafts, for engaging upper and lower portions of the opposite sides of the package;

horizontally moving means for moving at least said first pivot shaft with respect to said second pivot shaft depending on a change in width of said package; and vertically moving means for vertically moving said first and second upper guide members with respect to said first and second lower guide members depending on a change in height of said package.

34. A packaging and sealing apparatus according to claim 27, wherein said inserting means comprises:

pushing means for inserting the product into said package;

said pushing means comprising:

a pair of rollers for centering and pressing said product 20;

a pair of side guide plates disposed at the opposite sides of the package, respectively for preventing the product and said package out of contact with each other; and distance adjusting means for adjusting a distance between said rollers and a distance between said side guide plates depending on a change in dimensions of said product.

35. A packaging and sealing apparatus according to claim 27, wherein said open end forming mechanism comprises:

first and second forming arms disposed outwardly of the opposite sides of the package, respectively, and movable toward each other for folding inwardly gussets on opposite sides of the package;

closing means for closing the open end of the package with the gussets thereof being folded by said first and second forming arms;

actuator means for adjusting a distance between said first and second forming arms depending on a change in width of said package.

36. A packaging and sealing apparatus according to claim 35, wherein said closing means comprises:

first upper and lower grip plates for vertically gripping the open end of said package, said first upper and lower grip plates being movable toward and away from said package;

second upper and lower grip plates for vertically gripping the open end of said package at a position inward of a position in which said first upper and lower grip plates vertically grip the open end of said package; and third upper and lower grip plates for vertically gripping the open end of said package at a position inward of the position in which said second upper and lower grip plates vertically grip the open end of said package, said third upper and lower grip plates being movable along said conveyor to a position corresponding to said folding mechanism while gripping said open end of the package.

37. A packaging and sealing apparatus according to claim 27, wherein said folding mechanism comprises:

a plurality of folding stations having respective folder means engaging upwardly the open end of the package and folding the open end upwardly through about 180°; and feeder means for gripping the folded open end of the package and feeding the package between said folding stations.

38. A packaging and sealing apparatus according to claim 37, wherein said feeder means comprises:

a plurality of feed chucks for gripping the open end which is folded in said folding stations; and joint bars joining said feed chucks for moving said feed chucks in unison with each other.

39. A packaging and sealing apparatus according to claim 37, wherein said first folding station has folding means for folding vertically downwardly the open end of the package which extends horizontally.

40. A packaging and sealing apparatus according to claim 39, wherein said folding means comprises:

a movable folding plate which is movable back and forth horizontally and vertically; and a fixed folding plate for folding vertically downwardly the open end of the package in coaction with said movable folding plate.

41. A packaging and sealing apparatus according to claim 27, further comprising:

a transfer device for positioning and transferring the package onto said conveyor;

a lower suction belt for attracting under suction a lower surface of the package from said transfer device to a position corresponding to said inserting mechanism; and an upper suction belt for attracting under suction an upper surface of the package from said transfer device to the position corresponding to said inserting mechanism.

42. A packaging and sealing apparatus according to claim 27, further comprising a cam mechanism for actuating said opening mechanism 18, said inserting mechanism, said open end forming mechanism, said folding mechanism, and said sealing mechanism in unison with each other in synchronism with said conveyor.

43. A packaging and sealing apparatus according to claim 27, further comprising a sealing mechanism for fixing the folded end, said sealing mechanism comprising:

tape drawing means for gripping a leading end of an adhesive tape and withdrawing the adhesive tape by a predetermined length;

a bonding roller for pressing an adhesive surface of the adhesive tape withdrawn by said tape drawing means against the folded end of said package;

moving means for moving said bonding roller in at least two directions crossing each other depending on a shape of said package; and cutter means movable toward and away from the adhesive tape for cutting off the adhesive tape at a given position thereon while the adhesive tape is being applied by said bonding roller.

44. A packaging and sealing apparatus according to claim 43, wherein said tape drawing means comprises:

movable bases movable back and forth by an actuator;

chuck rollers angularly movably mounted on said movable bases; and chuck plates fixed to said movable bases for gripping the leading end of said adhesive tape in coaction with said chuck rollers.

45. A packaging and sealing apparatus according to claim 43, further comprising a bonding member movable back and forth for bonding the leading end of the withdrawn adhesive tape to said package.

46. A packaging and sealing apparatus according to claim 43, further comprising pressers movable back and forth for supporting said package.

47. A packaging and sealing apparatus according to claim 43, further comprising:

tape unreeling means for unreeling said adhesive tape from a tape reel;

said tape unreeling means comprising rotatable feed rollers having knurled circumferential surfaces, respectively.

48. A packaging and sealing apparatus according to claim 47, wherein said feed rollers comprise a plurality of thin rollers of metal, said tape unreeling means further comprising a plurality of rotatable thin resin rollers axially alternating with and radially overlapping said thin rollers of metal.

* * * * *